US008849655B2

(12) United States Patent
Liu et al.

(10) Patent No.: US 8,849,655 B2
(45) Date of Patent: Sep. 30, 2014

(54) ENCODER, DECODER AND METHODS THEREOF

(75) Inventors: Zongxian Liu, Singapore (SG); Kok Seng Chong, Singapore (SG)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 364 days.

(21) Appl. No.: 13/504,272

(22) PCT Filed: Oct. 29, 2010

(86) PCT No.: PCT/JP2010/006394

§ 371 (c)(1),
(2), (4) Date: Apr. 26, 2012

(87) PCT Pub. No.: WO2011/052221

PCT Pub. Date: May 5, 2011

(65) Prior Publication Data

US 2012/0215526 A1 Aug. 23, 2012

(30) Foreign Application Priority Data

Oct. 30, 2009 (JP) ..... 2009-250441

(51) Int. Cl.

| | |
|---|---|
| ***G10L 19/12*** | (2013.01) |
| ***G10L 19/14*** | (2006.01) |
| ***G10L 19/02*** | (2013.01) |
| ***G10L 19/00*** | (2013.01) |
| ***G10L 19/10*** | (2013.01) |

(52) U.S. Cl.

CPC ..... *G10L 19/0212* (2013.01); *G10L 19/10* (2013.01)

USPC ..... 704/222; 704/205; 704/223; 704/224; 704/225; 704/229; 704/230; 704/500

(58) Field of Classification Search

USPC ..... 704/205, 222, 223, 224, 225, 229, 230, 704/500

See application file for complete search history.

(56) References Cited

U.S. PATENT DOCUMENTS 5,493,647 A 2/1996 Miyasaka et al.
5,717,824 A * 2/1998 Chhatwal ..... 704/222

(Continued)

FOREIGN PATENT DOCUMENTS

CN 1242860 1/2000
JP 07-253796 10/1995

(Continued)

OTHER PUBLICATIONS

ITU-T:G.718, "Frame error robust narrow-band and wideband embedded variable bit-rate coding of speech and audio from 8-32 kbit/s", ITU-T Recommendation G.718, Jun. 2008.*

(Continued)

*Primary Examiner* — Edgar Guerra-Erazo
(74) *Attorney, Agent, or Firm* — Greenblum & Bernstein, P.L.C.

(57) ABSTRACT

An encoder whereby the bit efficiency of encoding can be improved, thereby improving the qualities of signals as decoded. In the encoder: a time-frequency converting unit (101) converts signals, which are to be encoded, to frequency domain signals; an adaptive spectrum formation encoding unit (102) determines an effective range in the frequency band of the frequency domain signals; and a pulse vector encoding unit (103) pulse vector encodes only the signal components within the effective range.

11 Claims, 21 Drawing Sheets

(56) References Cited

U.S. PATENT DOCUMENTS

| | | | | |
|---|---|---|---|---|
| 6,260,017 | B1 | 7/2001 | Das et al. | |
| 6,415,254 | B1 | 7/2002 | Yasunaga et al. | |
| 6,532,443 | B1 * | 3/2003 | Nishiguchi et al. | 704/200.1 |
| 6,757,650 | B2 * | 6/2004 | Yasunaga et al. | 704/223 |
| 8,301,441 | B2 * | 10/2012 | Vos | 704/230 |
| 8,392,182 | B2 * | 3/2013 | Vos | 704/230 |
| 2002/0161575 | A1 | 10/2002 | Yasunaga et al. | |
| 2004/0143432 | A1 | 7/2004 | Yasunaga et al. | |
| 2005/0203734 | A1 | 9/2005 | Yasunaga et al. | |
| 2006/0080091 | A1 | 4/2006 | Yasunaga et al. | |
| 2007/0033019 | A1 | 2/2007 | Yasunaga et al. | |
| 2007/0255558 | A1 | 11/2007 | Yasunaga et al. | |
| 2008/0275698 | A1 * | 11/2008 | Yasunaga et al. | 704/222 |
| 2009/0132247 | A1 | 5/2009 | Yasunaga et al. | |
| 2009/0138261 | A1 | 5/2009 | Yasunaga et al. | |
| 2009/0231169 | A1 | 9/2009 | Mittal et al. | |
| 2010/0017200 | A1 | 1/2010 | Oshikiri et al. | |
| 2010/0174547 | A1 * | 7/2010 | Vos | 704/500 |
| 2010/0217609 | A1 * | 8/2010 | Oshikiri | 704/500 |
| 2010/0228544 | A1 | 9/2010 | Yasunaga et al. | |
| 2010/0250244 | A1 | 9/2010 | Zhong et al. | |
| 2011/0046946 | A1 | 2/2011 | Liu et al. | |
| 2012/0166189 | A1 * | 6/2012 | Vos | 704/230 |

FOREIGN PATENT DOCUMENTS

| | | |
|---|---|---|
| JP | 10-091195 | 4/1998 |
| JP | 2001-100796 | 4/2001 |
| JP | 2002-544551 | 12/2002 |
| JP | 2009-042733 | 2/2009 |

OTHER PUBLICATIONS

Cuperman, V., "On adaptive vector transform quantization for speech coding," Communications, IEEE Transactions on , vol. 37, No. 3, pp. 261-267, Mar. 1989.*

Mittal, U. et al., "Low Complexity Factorial Pulse Coding of MDCT Coefficients Using Approximation of Combinatorial Functions", IEEE, 2007, vol. 1, pp. I289-I292.

Lefebvre, R. et al., "High quality coding of wideband audio signals using transform coded excitation (TCX)", IEEE, 1994, pp. I-193-I-196.

Brandenburg, K., "MP3 and AAC Explained", AES 17th International Conference on High Quality Audio Coding, 1999, pp. 1-12.

Mittal, U. et al., "Low Complexity Factorial Pulse Coding of MDCT Coefficients Using Approximation of Combinatorial",2007, vol. 1, pp. I289-I292.

Vaillancourt, T. et al., "ITU-T EV-VBR: A robust 8-32 kbit/s Scalable Coder for Error Prone Telecommunications Channels".

* cited by examiner

BIT : THE NUMBER OF AVAILABLE BITS

N : THE NUMBER OF SPECTRUM COEFFICIENTS

M : THE NUMBER OF PULSES

ENCODER, DECODER AND METHODS THEREOF

TECHNICAL FIELD

The present invention relates to an encoder, a decoder and a method thereof.

BACKGROUND ART

As speech coding, there are mainly two types of coding technologies, that is to say, transform coding and transform coded excitation (TCX) coding (for example, Non-Patent Literature 1).

Transform coding involves, for example, a step of converting a signal from the time domain to the frequency domain using discrete Fourier transform (DFT) or modified discrete cosine transform (MDCT). Also, transform coding performs quantizing and encoding spectrum coefficients. As general transform coding, there are MPEG MP3, MPEG AAC (for example, Non-Patent Literature 2), and Dolby AC3. Transform coding is efficient for a music signal and a general speech signal. FIG. 1 shows a simplified configuration of transform coding system 10.

In an encoder of transform coding system 10 shown in FIG. 1, time-frequency conversion section 11 converts time domain signal S(n) into frequency domain signal S(f) using discrete Fourier transform (DFT), modified discrete cosine transform (MDCT), or the like. Spectrum coefficient quantizing section 12 acquires a quantized parameter by quantizing frequency domain signal S(f). Multiplexing section 13 multiplexes the quantized parameter and transmits the result to the decoder side.

In a decoder of transform coding system 10 shown in FIG. 1, demultiplexing section 14 first demultiplexes all bit stream information to generate a quantized parameter. Spectrum coefficient decoding section 15 decodes the quantized parameter to generate decoded frequency domain signal S(f). Frequency-time conversion section 16 generates decoded time domain signal S(n) by converting the decoded frequency domain signal S(f), into the time domain using inverse discrete Fourier transform (IDFT), inverse modified discrete cosine transform (IMDCT) or the like.

By contrast with this, the combination of a time domain (linear prediction) method and a frequency domain (transform coding) method is employed in TCX coding. TCX coding acquires a residual (excitation) signal by utilizing redundancy of a speech signal in the time domain using linear prediction for an input speech signal. In the case of a speech signal, especially, in the case of an active speech section (a resonance effect and a high pitch frequency component), an audio reproducing signal is efficiently generated in this model. After linear prediction, a residual (excitation) signal is converted into the frequency domain and efficiently encoded. As general TCX coding, there are AMR-WB-E, ITU.T G.729.1, and ITU.T G.718 (for example, Non-Patent Literature 4). FIG. 2 shows a brief configuration of TCX coding system 20.

In an encoder of TCX coding system 20 shown in FIG. 2, LPC analysis section 21. performs LPC analysis for an input signal in order to utilize signal redundancy in the time domain. LPC inverse filtering section 22 acquires residual (excitation) signal $S_r(n)$ using LPC coefficients from LPC analysis by applying a LPC inverse filter to input signal S(n). Time-frequency conversion section 23 converts residual signal $S_r(n)$ into frequency domain signal $S_r(f)$ using, for example, discrete Fourier transform (DFT), modified discrete cosine transform (MDCT) or the like. Spectrum coefficient quantizing section 24 quantizes frequency domain signal $S_r(f)$, and multiplexing section 25 multiplexes a quantized parameter and transmits the result to the decoder side.

In a decoder of TCX coding system 20 shown in FIG. 2, demultiplexing section 26 first demultiplexes all bit stream information to generate a quantized parameter. Spectrum coefficient decoding section 27 decodes the quantized parameter and generates decoded frequency domain residual signal $S_r(f)$. Frequency-time conversion section 28 generates decoded time domain signal $S_r(n)$ by converting decoded frequency domain signal $S_r(f)$, into the time domain using inverse discrete Fourier transform (IDFT), inverse modified discrete cosine transform (IMDCT) or the like. LPC synthesis filtering section 29 processes decoded time domain residual signal $S_r(n)$ using the decoded LPC parameter and acquires decoded time domain signal S(n).

Transform coding part in both transform coding and TCX coding is normally carried out by utilizing any quantizing method. One of vector quantization is referred to as pulse vector coding.

For example, Non-Patent Literature 3 discloses factorial pulse coding (one of pulse vector coding) which quantizes a LPC residual in the MDCT domain (see FIG. 4). Factorial pulse coding is one of pulse vector coding, and coding information of pulse vector coding is a unit magnitude pulse. In newly standardized speech coding ITU-T G.718, factorial pulse coding (FPC) is employed in the fifth layer for the purpose of quantizing a LPC residual in the MDCT domain.

In an encoder of TCX coding system 30 shown in FIG. 3, MDCT section 31 converts time domain signal $S_r(n)$ into frequency domain signal $S_r(f)$ by modified discrete cosine transform. FPC coding section 32 quantizes a LPC residual in the MDCT domain. In this encoder, a plurality of pulses, their positions, their amplitudes, and their polarities are acquired by pulse vector coding. Further, a global gain is calculated to normalize the pulses into unit magnitude. FIG. 4 shows one of configuration examples of FPC coding section 32. As shown in FIG. 4, a coding parameter of pulse vector coding is a global gain, a pulse position, a pulse amplitude, and a pulse polarity.

FIG. 5 shows a relationship between the number of pulses which can be encoded (referred to as M) and the number of spectrum coefficients of an input signal (referred to as N). As shown in FIG. 5, in the case of pulse vector coding, M representing the number of pulses which can be encoded depends on N representing the number of spectrum coefficients of an input signal, and the number of available bits. That is to say, when the number of available bits is fixed, as N is greater, M is smaller, or as N is smaller, M is greater. When N is fixed, as the number of available bits is greater, M is greater, or as the number of available bits is smaller, M is smaller.

FIG. 6 shows a concept of pulse vector coding. In input spectrum S(f) having N length, M pulses, their positions, their amplitudes, their polarities, and one global gain are together encoded. By contrast with this, in generated decoded spectrum S(f), only M pulses, and their positions, their amplitudes, and their polarities are generated, and all of spectrum coefficients other than those are set to zero.

CITATION LIST

Non-Patent Literature

NPL 1
Lefebvre, et al, "High quality coding of wideband audio signals using transform coded excitation (TCX)", IEEE International Conference on Acoustics, Speech, and Signal Processing, vol. 1, pp. 1/193-1/196, April 1994

NPL 2

Karl Heinz Brandenburg, "MP3 and AAC Explained", AES 17th International Conference, Florence, Italy, September 1999.

NPL 3

Udar Mittal, James P.Ashley and Edgardo M. Cruz_Zeno "Low complexity factorial pulse coding of MDCT coefficients using approximation of combinatorial functions", IEEE International Conference on Acoustics, Speech and Signal Processing, pp. 1-289-1-292, April 2007.

NPL 4

T. Vaillancourt et al, "ITU-T EV-VBR: A Robust 8-32 kbit/s Scalable Coder for Error Prone Telecommunication Channels", in Proc. Eusipco, Lausanne, Switzerland, August 2008

SUMMARY OF INVENTION

Technical Problem

By the way, at a low bit rate, the number of spectrum coefficients to be encoded is normally much greater than the number of pulses encoded by pulse vector coding. For example, four conditions referred in Non-Patent Literature 3 are shown in the following table 1.

TABLE 1

| N(the number of spectrum coefficients) | M(the number of pulses) | The number of available bits |
|---|---|---|
| 54 | 7 | 35 |
| 144 | 28 | 131 |
| 144 | 44 | 180 |
| 144 | 60 | 220 |

In the fifth layer in G.718, a relationship between the number of spectrum coefficients N and M representing the number of pulses which can be encoded is shown in the following table 2.

TABLE 2

| N(the number of spectrum coefficients) | M(the number of pulses) | The number of available bits |
|---|---|---|
| 279 | 26 | 156 |

In view of the above, N is much greater than M in most conditions.

Here, when N is great, more bits are required for encoding a pulse position. By this means, more bits are required for encoding each pulse. Accordingly, when a bit rate is not sufficiently high, only several pluses can be encoded. As a result, when a bit rate is not sufficiently high, a large part of a spectrum remains unencoded and this may cause a situation where sound quality of a decoded signal is extremely poor.

It is therefore an object of the present invention to provide an encoder, a decoder, and a method thereof which can improve decoded signal quality by improving bit efficiency in coding.

Solution to Problem

An encoder according to the present invention employs a configuration to include a time-frequency conversion section that converts a coding target signal into a frequency domain signal; an effective range specifying section that specifies an effective range in a frequency band of the frequency domain signal; and a pulse vector coding section that performs pulse vector coding on only a signal component within the effective range.

A decoder according to the present invention employs a configuration to include a pulse vector decoding section that performs pulse vector decoding on a pulse coding parameter coded in the above encoder; a spectrum forming section that sets a decoded signal acquired in the pulse vector decoding section to a band corresponding to the effective range; and a frequency-time conversion section that converts a decoded signal set to the band corresponding to the effective range into a time domain signal.

A coding method according to the present invention employs a configuration to include a step of converting a coding target signal into a frequency domain signal; a step of specifying an effective range in a frequency band of the frequency domain signal; and a step of performing pulse vector coding on only a signal component within the effective range.

A decoding method according to the present invention employs a configuration to include a decoding step of performing pulse vector decoding on a pulse coding parameter coded in the above coding method; a spectrum forming step of setting a decoded signal acquired in the decoding step, to a band corresponding to the effective range; and a converting step of converting a decoded signal arranged in the band corresponding to the effective range into a time domain signal.

Advantageous Effects of Invention

According to the present invention, it is possible to provide spectrum coefficients coding apparatus, a decoder, and a method thereof which can improve decoded signal quality by improving bit efficiency in coding.

DESCRIPTION OF EMBODIMENTS

Embodiments according to the present invention will be described below in detail with reference to the drawings. In the embodiments, identical configuration elements are assigned the same reference codes, and duplicate descriptions thereof are omitted.

(Embodiment 1)

Figure 1:
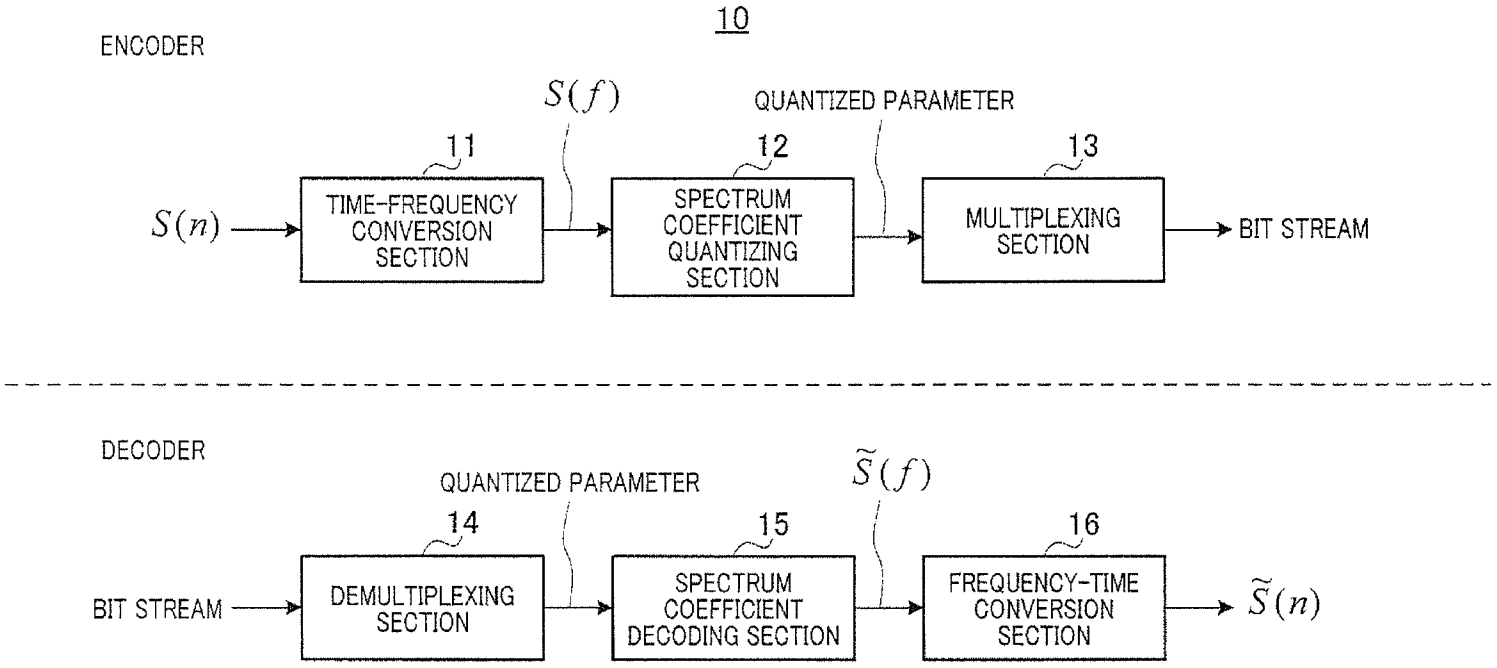
FIG. 1 is a block diagram showing a configuration of a conventional transform coding system.
Figure 2:
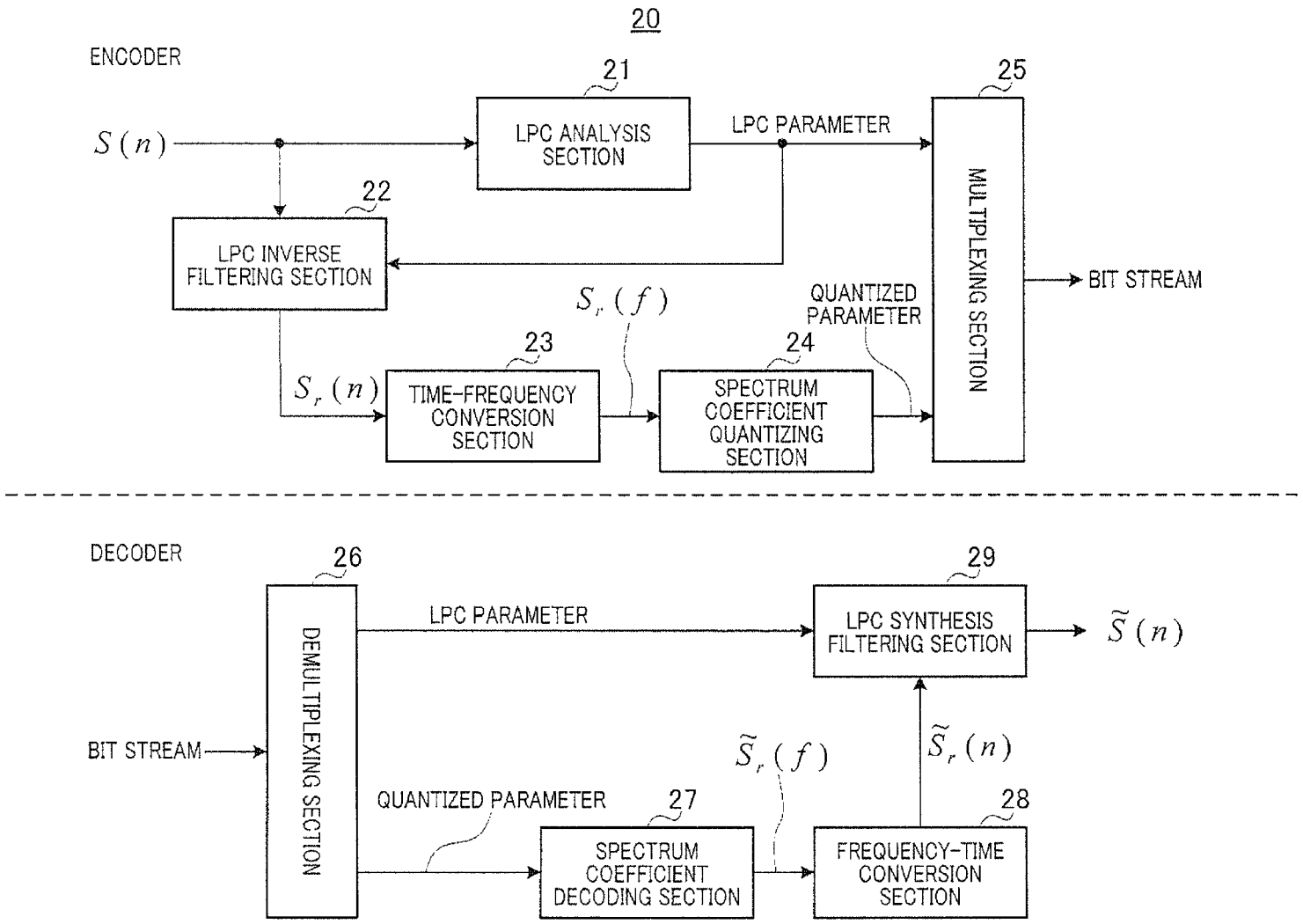
FIG. 2 is a block diagram showing a configuration of a conventional TCX coding system.
Figure 3:
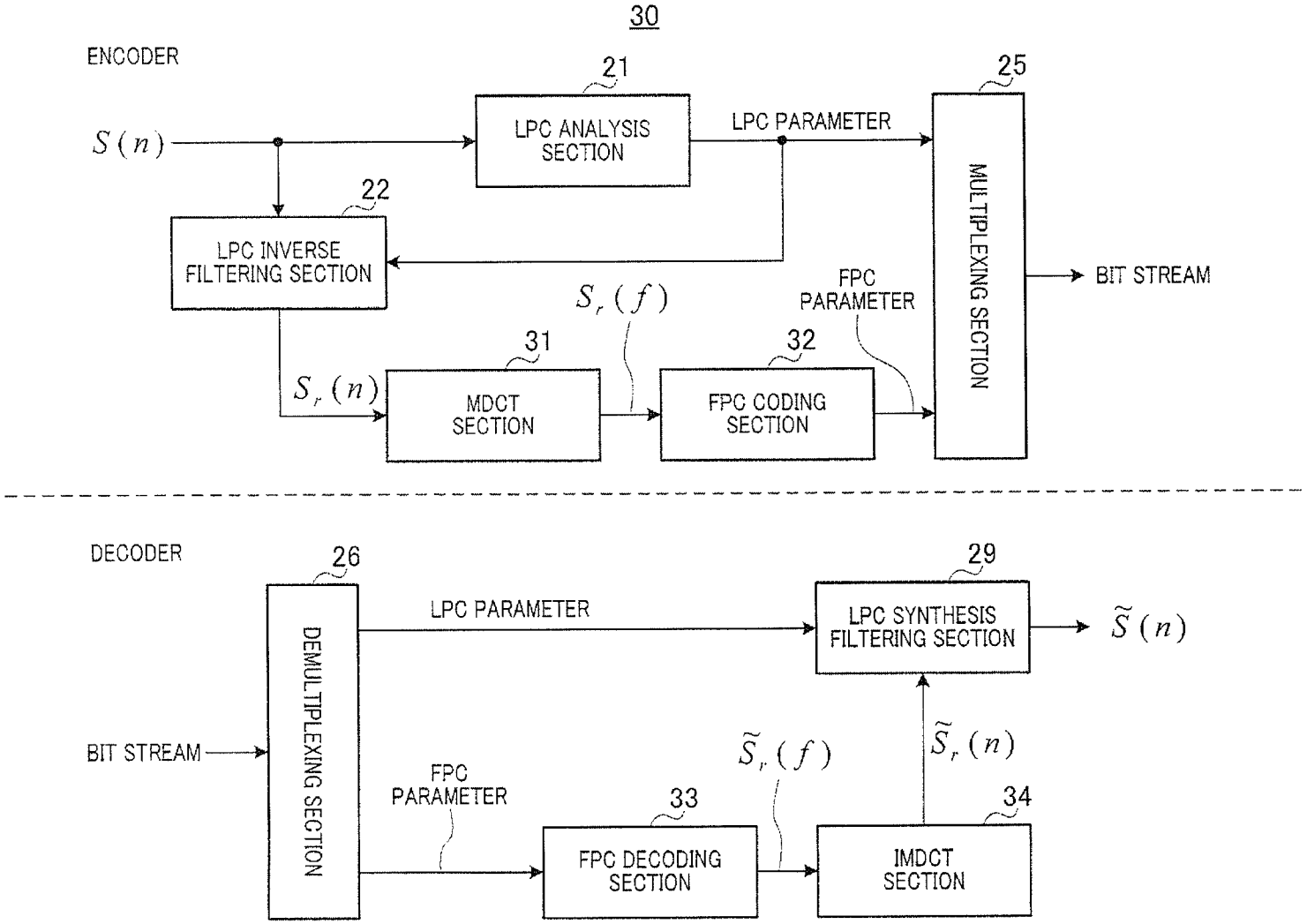
FIG. 3 is a block diagram showing a configuration of a TCX coding system disclosed in Non-Patent Literature 3.
Figure 4:
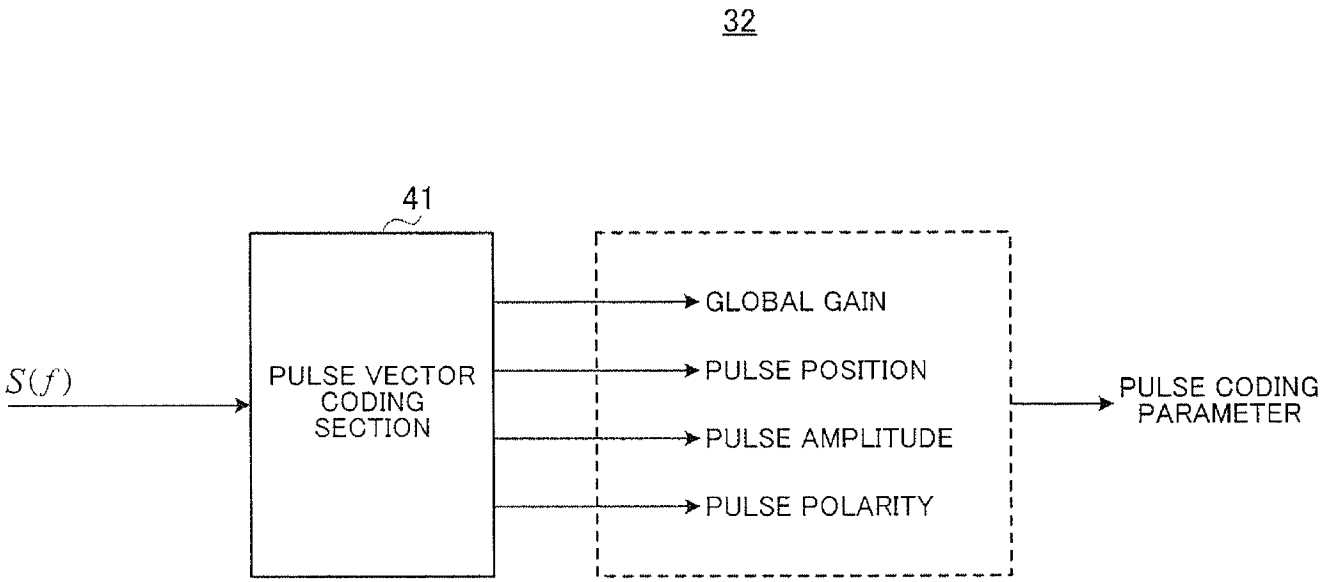
FIG. 4 shows a configuration of a FPC coding section in FIG. 3.
Figure 5:
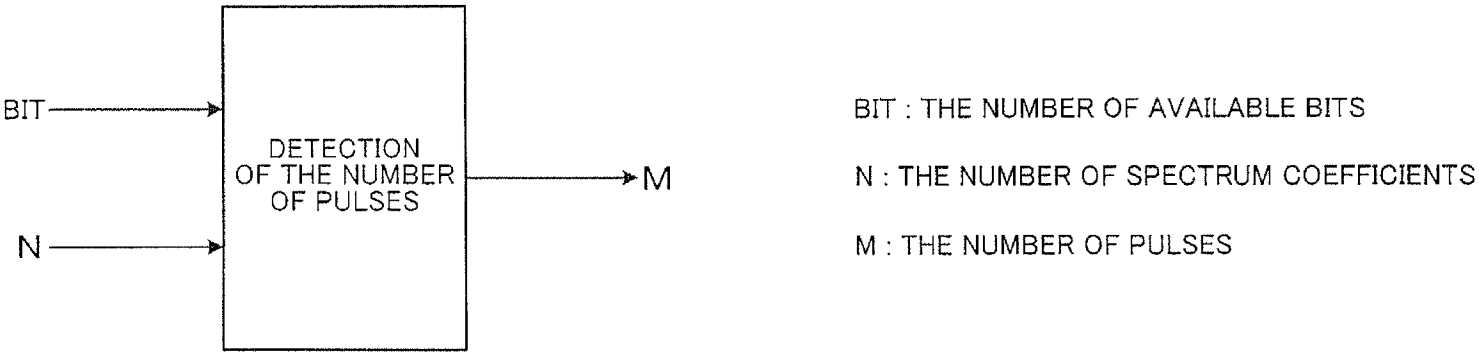
FIG. 5 shows a relationship between the number of pulses which can be encoded and the number of spectrum coefficients of an input signal.
Figure 6:
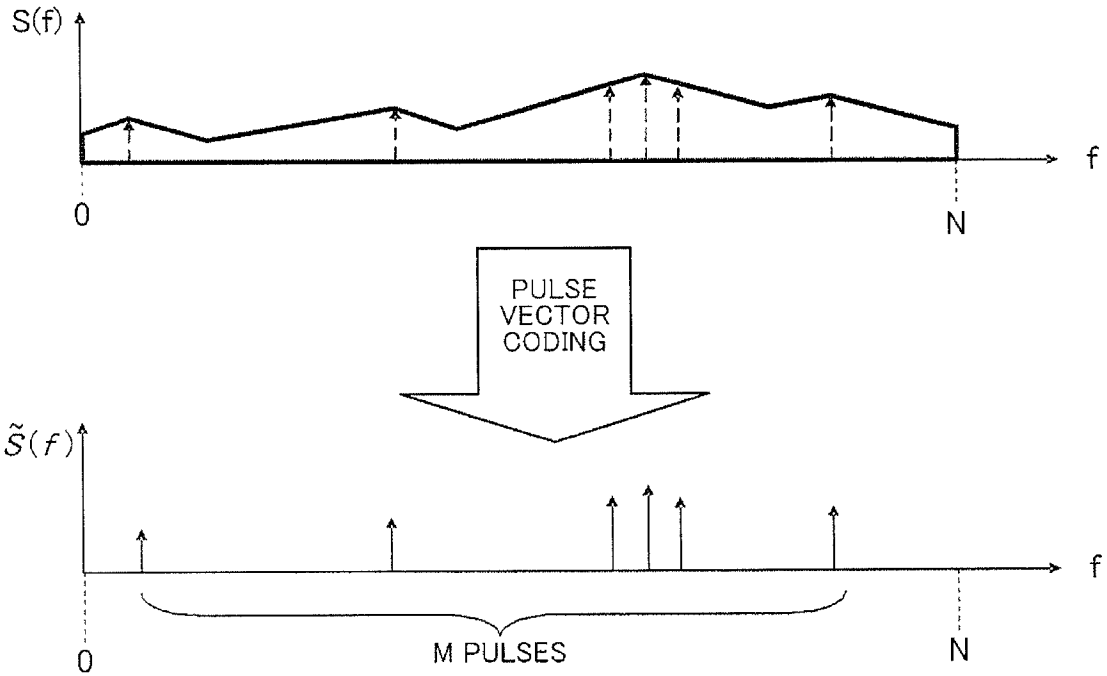
FIG. 6 shows a concept of pulse vector coding.
Figure 7:
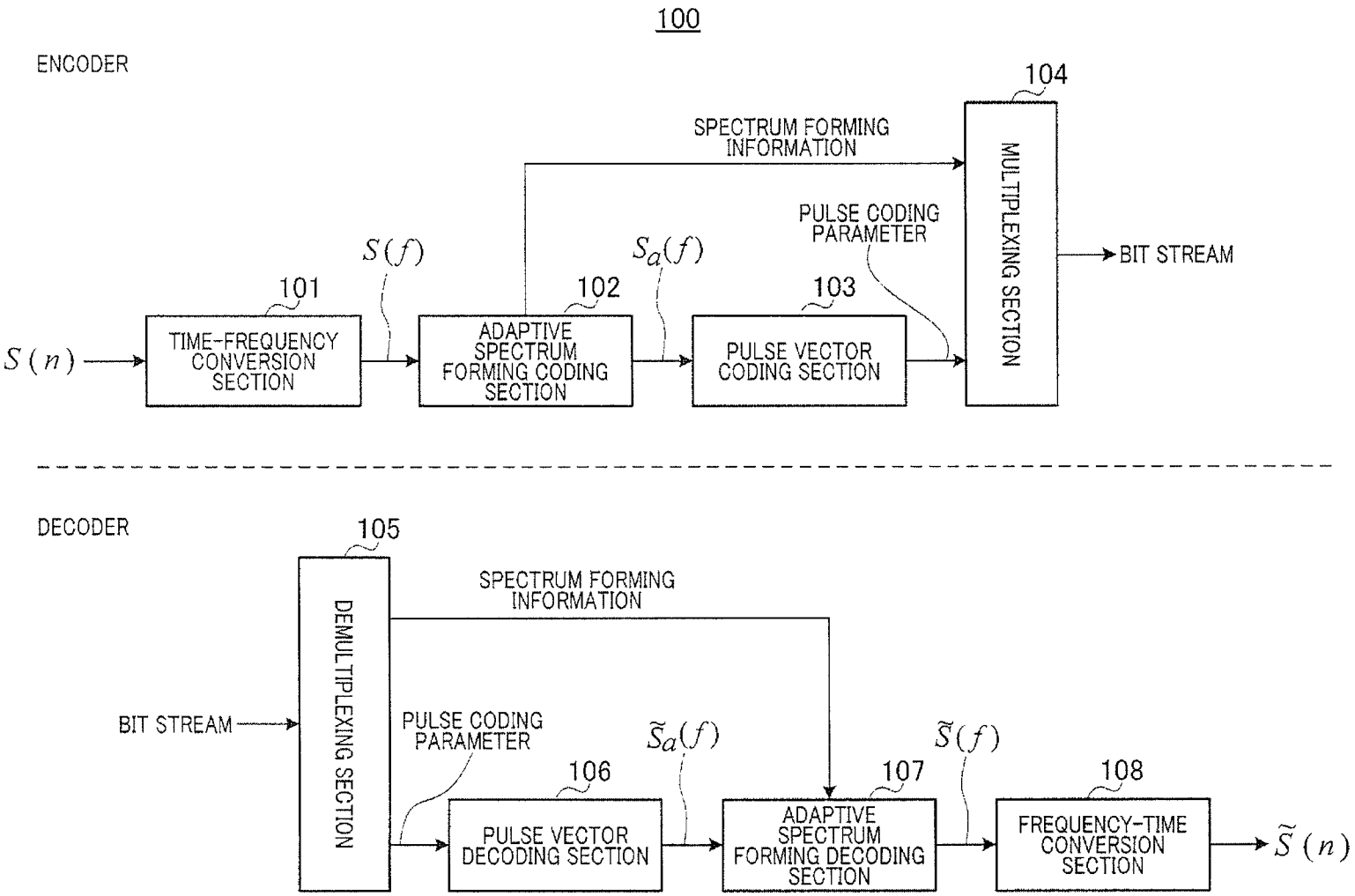
FIG. 7 is a block diagram showing a configuration of a coding system according to Embodiment 1 of the present invention.

FIG. 7 is a block diagram showing a configuration of coding system 100 according to Embodiment 1 of the present invention. Here, coding system 100 has an encoder which applies an adaptive spectrum forming technology to pulse vector coding and a decoder. In FIG. 7, an encoder has time-frequency conversion section 101, adaptive spectrum forming coding section 102, pulse vector coding section 103, and multiplexing section 104. On the other hand, a decoder has demultiplexing section 105, pulse vector decoding section 106, adaptive spectrum forming decoding section 107, and frequency-time conversion section 108.

In FIG. 7, time-frequency conversion section 101 converts time domain signal S(n) into frequency domain signal S(f) using discrete Fourier transform (DFT), modified discrete cosine transform (MDCT) or the like.

Adaptive spectrum forming coding section 102 acquires "an effective range" in a frequency band of S(f) and acquires $S_a(f)$ which falls within the effective range in S(f). Also, adaptive spectrum forming coding section 102 calculates spectrum coefficients of $S_a(f)$ which falls within the effective range. Adaptive spectrum forming coding section 102 outputs the spectrum coefficient of $S_a(f)$ which falls within the effective range to pulse vector coding section 103, and transmits spectrum forming information showing the effective range to the decoder side through multiplexing section 104.

Pulse vector coding section 103 performs pulse vector coding for the spectrum coefficient of $S_a(f)$ which falls within the effective range, thereby acquiring a pulse coding parameter such as a pulse position, a pulse amplitude, a pulse polarity, and a global gain.

Multiplexing section 104 multiplexes the pulse coding parameter acquired in pulse vector coding section 103 with the spectrum forming information and transmits the result to the decoder side.

Also, in a decoder shown in FIG. 7, demultiplexing section 105 receives a bit stream as input and demultiplexes the input hit stream into spectrum forming information, and a pulse coding parameter.

Pulse vector decoding section 106 acquires spectrum coefficients of $S_a(f)$ by decoding a pulse coding parameter. $S_a(f)$ corresponds to $S_a(f)$ and is a base signal for forming S(f) which is a decoded signal of S(f).

Adaptive spectrum forming decoding section 107 generates frequency domain signal S(f) using $S_a(f)$ and spectrum forming information showing an effective range. Specifically, adaptive spectrum forming decoding section 107 generates frequency domain signal S(f) by setting $S_a(f)$ which is a decoding result in pulse vector decoding section 106 to a band in an effective range.

Frequency-time conversion section 108 generates time domain signal S(n) by converting frequency domain signal S(f), into the time domain using inverse discrete Fourier transform (IDFT), inverse modified discrete cosine transform (IMDCT) or the like.

Figure 8:
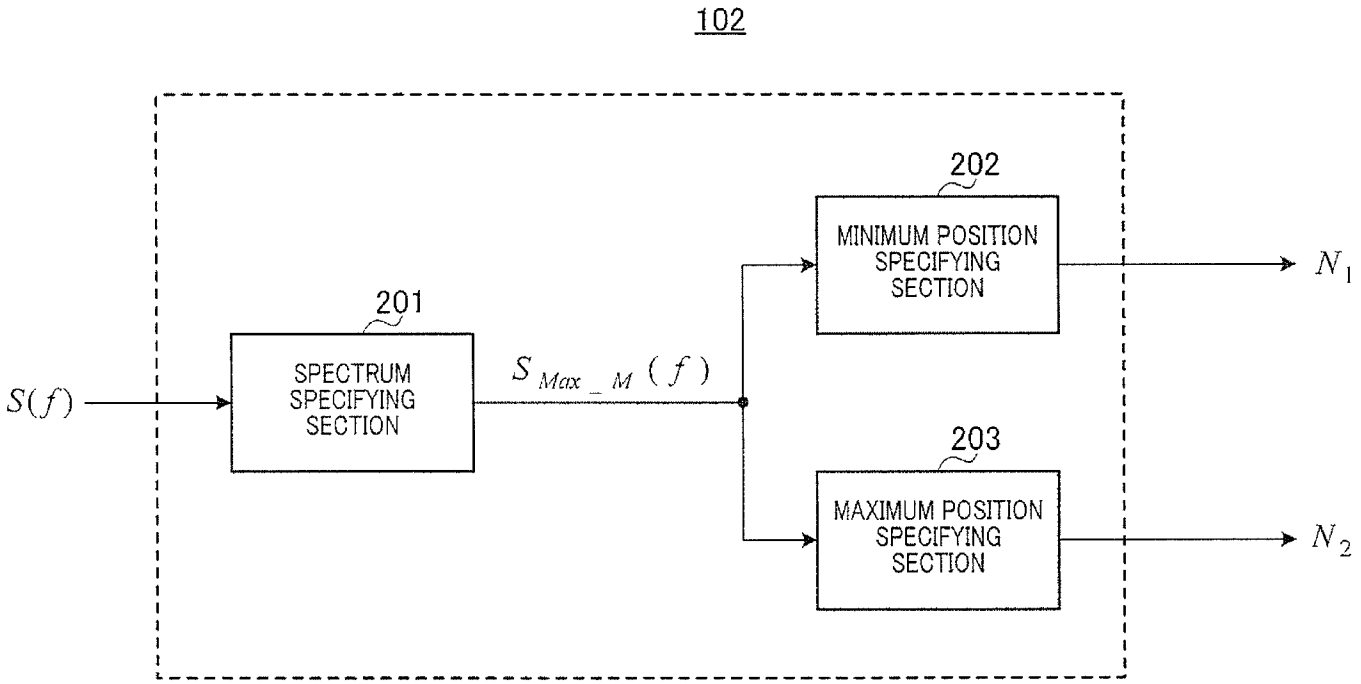
FIG. 8 is a block diagram showing a configuration of an adaptive spectrum forming coding section shown in FIG. 7.

FIG. 8 is a block diagram showing a configuration of adaptive spectrum forming coding section 102. In FIG. 8, adaptive spectrum forming coding section 102 has spectrum specifying section 201, minimum position specifying section 202, and maximum position specifying section 203.

Of the overall spectrum of frequency domain signal S(f), spectrum specifying section 201 specifies the top M spectrum coefficients of an amplitude absolute value (that is to say, a plurality of spectrum coefficients in descending order of an amplitude absolute value). Here, M is the number of pulses to be encoded and is derived from the number of available bits, and the number of frequency domain signal S(f). $S_{Max_M}(f)$ in FIG. 8 represents the top M spectrum coefficients.

Minimum position specifying section 202 detects minimum position (the lowest frequency) $N_1$ among the top M spectrum coefficients of an amplitude absolute value.

Maximum position specifying section 203 detects maximum position (the highest frequency) $N_2$ among the top M spectrum coefficients of an amplitude absolute value.

Here, one of the simplest methods for detecting minimum position $N_1$ and maximum position $N_2$ is to store positions of M spectrum coefficients in a sequence and then performs sorting so as to acquire a maximum value and a minimum value in the sequence. A maximum value of positions calculated in this way is $N_2$ and a minimum value thereof is $N_1$. A part between $N_1$ and $N_2$ is "an effective range," and it is considered that there is no pulse in the remaining spectrum. This minimum position $N_1$ and maximum position $N_2$ represent spectral shape information and are transmitted (reported) to the decoder side through multiplexing section 104.

Figure 9:
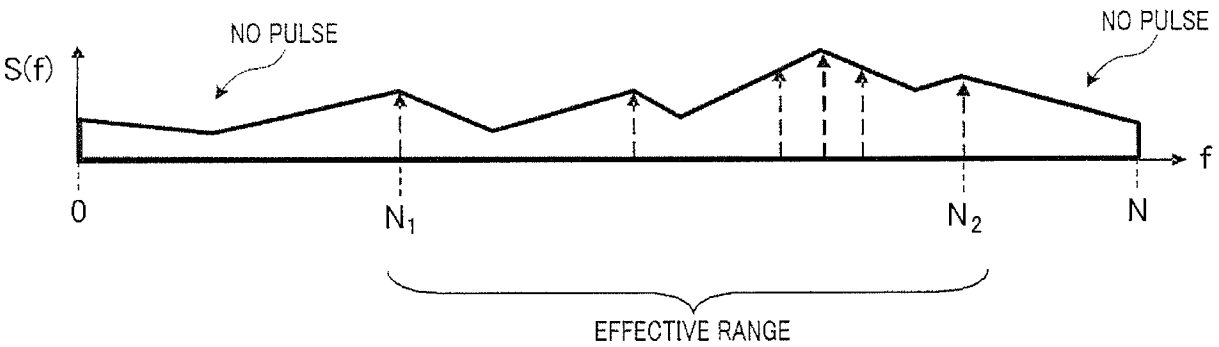
FIG. 9 illustrates coding in a coding system according to Embodiment 1 of the present invention.
Figure 10:
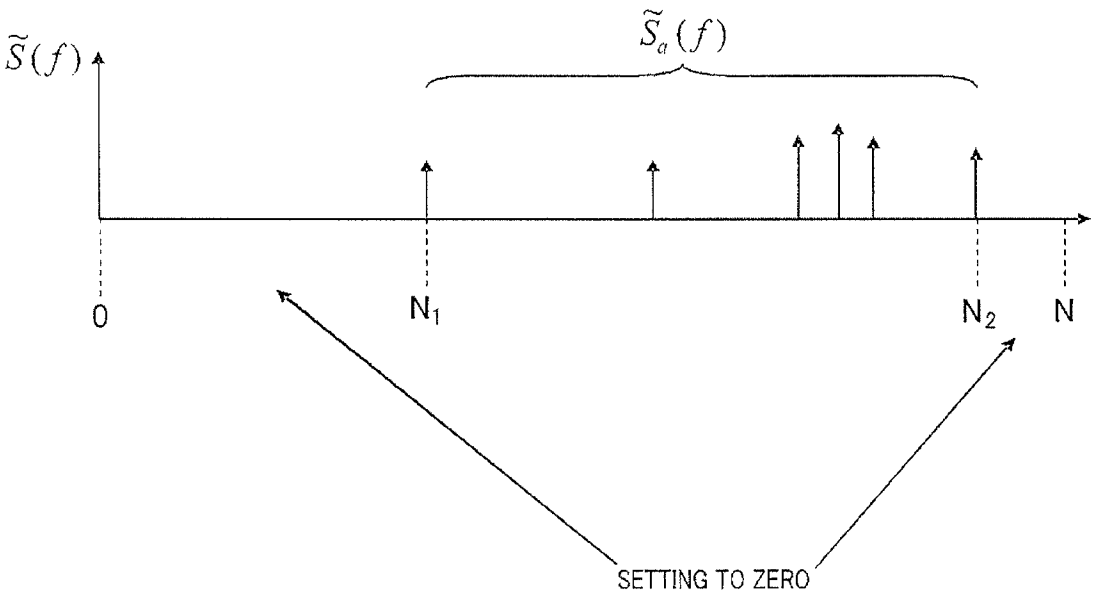
FIG. 10 illustrates decoding in a coding system according to Embodiment 1 of the present invention.

Operations of coding system 100 having the above configuration will be explained. FIG. 9 and FIG. 10 illustrate operations of coding system 100.

In an encoder of coding system 100, adaptive spectrum forming coding section 102 specifies an effective range (a range between $N_1$ and $N_2$ in FIG. 9) which is a part of a frequency band of S(f) (a range from zero to N in FIG. 9). Also, adaptive spectrum forming coding section 102 specifies spectrum coefficients of $S_a(f)$ within the effective range.

Specifically, in spectrum specifying section 201 of adaptive spectrum forming coding section 102, the top M spectrum coefficients of an amplitude absolute value are specified of the overall spectrum of frequency domain signal S(f). Then, in minimum position specifying section 202, minimum position $N_1$ (the lowest frequency) is detected among the top M spectrum coefficients of an amplitude absolute value, and maximum position specifying section 203 detects maximum position $N_2$ (the highest frequency) among the top M spectrum coefficients of an amplitude absolute value. An effective range is a range where $N_1$ is the starting point and $N_2$ is the end point.

Next, pulse vector coding section 103 acquires a pulse coding parameter by performing pulse vector coding on the spectrum coefficient within an effective range, which is specified in adaptive spectrum forming coding section 102. Here, it is considered that there is no pulse in a spectrum which is out of an effective range. The pulse coding parameter and spectrum forming information showing an effective range, which are acquired in this way, are multiplexed in multiplexing section 104 and transmitted to the decoder side.

In this way, it is possible to reduce the number of spectrum coefficients which are a target of pulse vector coding by applying pulse vector coding to not the overall spectrum but only a part thereof, thereby making it possible to reduce the number of bits required for encoding a pulse. That is to say, it is possible to improve bit efficiency in coding. Further, it is possible to improve decoded signal quality by utilizing the reduced bits as described below. The method for utilizing the bits includes, first, increasing the number of pulses using the reduced bits, and second, using the reduced bits for encoding other parameters without changing the number of pulses.

In a decoder of coding system 100, adaptive spectrum forming decoding section 107 receives a pulse vector decoding result which corresponds to spectrum coefficients of $S_a(f)$ in an encoder, and spectrum forming information. Then, adaptive spectrum forming decoding section 107 can form frequency domain signal S(f) which corresponds to S(f) in an encoder by arranging a pulse vector decoding result within an effective range shown by spectrum forming information (see FIG. 10). At this time, adaptive spectrum forming decoding section 107 sets the spectrum which is out of an effective range to zero as shown in FIG. 10.

In view of the above, according to the present Embodiment, a spectrum effective range is determined by a range in which all pulses are arranged. That is to say, a spectrum effective range is adaptively determined in accordance with signal characteristics. Further, pulse vector coding is applied to not the overall spectrum but limited to an effective range. Since the number of spectrum coefficients within an effective range is smaller than the number of spectrum coefficients in the overall spectrum, the number of bits required for encoding the same number of pulses is reduced. That is to say, it is possible to improve bit efficiency in coding. Further, it is possible to improve decoded signal quality by utilizing reduced bits.

In the above-described Embodiment, the following modified examples are possible.

MODIFIED EXAMPLE 1

It is possible to apply any limitation upon specifying an effective range for the purpose of reducing the number of bits required for transmitting a starting position and an end position of the effective range. Here, an embodiment which sets a step size upon specifying an effective range to more than 1 will be explained.

Figure 11:
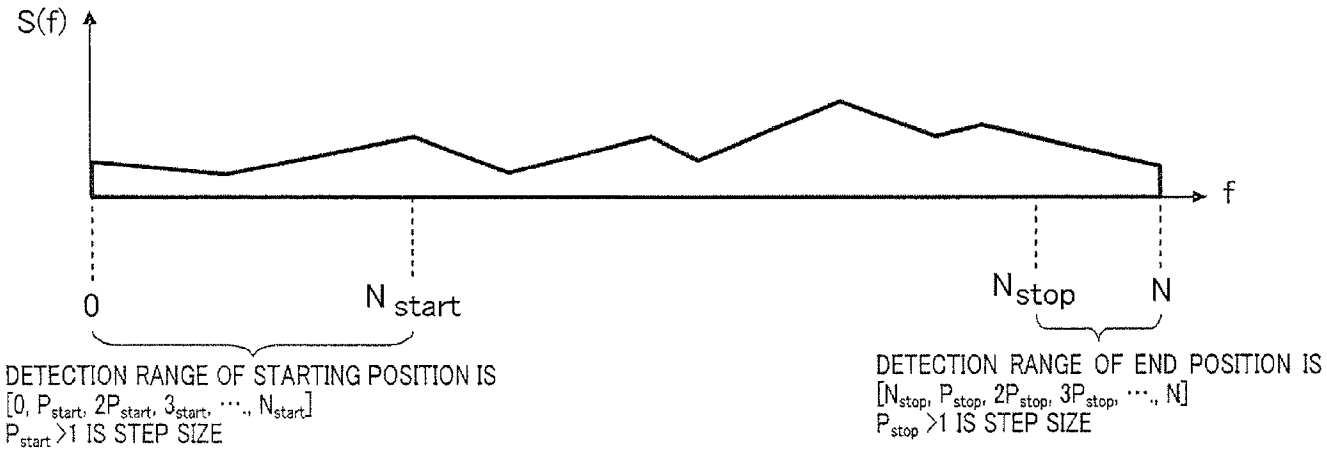
FIG. 11 illustrates a modified example 1 of Embodiment 1.

FIG. 11 briefly shows this embodiment.

In FIG. 11, a detection range of a starting position is limited to $[0, N_{start}]$, and a step size is not 1 but $P_{start}$ (>an integer of one). Also, a detection range of an end position is limited to $[N_{stop}, N]$, and a step size is not one but $P_{stop}$ (>an integer of one).

In view of the above, it is possible to reduce candidates of a starting position and an end position by setting a step width to an integer more than one upon specifying an effective range. As a result, it is possible to reduce bits required for transmitting a starting position and an end position.

MODIFIED EXAMPLE 2

In the above Embodiment 1, there has been described the method of reducing the number of bits required for pulse vector coding by an adaptive spectrum forming technology. Embodiment 1 also discloses that it is possible to improve decoded signal quality by arranging additional pulses between $N_1$ and $N_2$ using the reduced number of bits Then, limitation is provided where all additional pulses are arranged between $N_1$ and $N_2$. In addition, $N_1$ and $N_2$ are determined in accordance with the original number of pulses.

However, if the best position of an additional pulse is out of a range between $N_1$ and $N_2$, there is a problem that performance is not efficiently improved by this limitation. Accordingly, in modified example 2, to solve the problem, a configuration will be explained where an additional pulse can be arranged in a lower position (frequency) than $N_1$, or a higher position (frequency) than $N_2$, after N1 and N2 are determined. By this method, decoded signal quality can be further improved.

Figure 12:
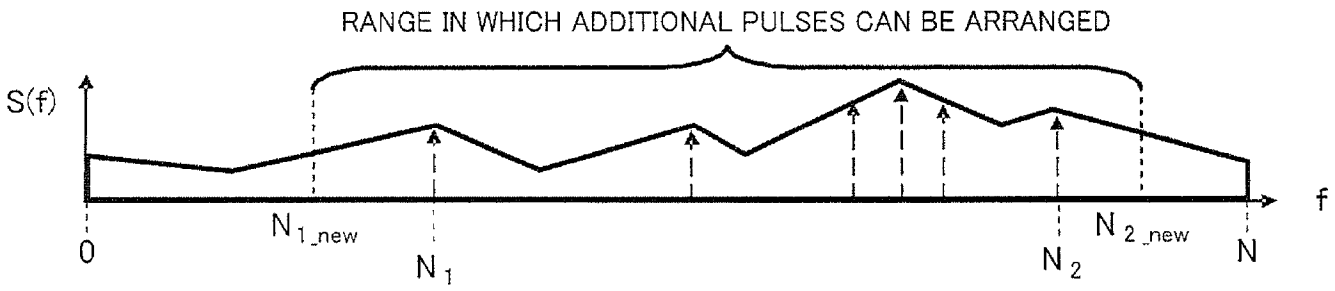
FIG. 12 illustrates a modified example 2 of Embodiment 1.

FIG. 12 shows a concept of processing of adaptive spectrum forming coding section 102 in modified example 2. In FIG. 12, an effective range of an additional pulse is not between $N_1$ and $N_2$ but between $N_{1_new}$ and $N_{2_new}$. Adaptive spectrum forming coding section 102 sets an effective range between $N_{1_new}$ and $N_{2_new}$, so that pulse vector coding section 103 applies pulse vector coding to the new effective range.

Adaptive spectrum forming coding section 102, for example, determines $N_{1_new}$ and $N_{2_new}$ using not M pluses but (M+J) pluses. Here, J is a predetermined number for determining $N_{1_new}$ and $N_{2_new}$. Adaptive spectrum forming coding section 102 determines positions of M pulses between $N_1$ and $N_2$ and then determines positions of additional pulses between $N_{1_new}$ and $N_{2_new}$. In this case, since an effective range is extended, adaptive spectrum forming coding section 102 recalculates the number of bits required for a range between $N_{1_new}$ and $N_{2_new}$. If the number of bits exceeds the number of available bits, adaptive spectrum forming coding section 102 discards some additional pulses such that the number of bits falls within the number of available bits, or narrows a range between $N_{1_new}$ and $N_{2_new}$ by adding a predetermined value to $N_{1_new}$ and subtracting a predetermined value from $N_{2_new}$.

In view of the above, a band (an effective range) in which a pulse is arranged in pulse vector coding is adaptively determined in accordance with the number of additional pulses. That is to say, modified example 2 has a feature of relieving the border of an effective range and includes the best position of an additional pulse for this feature. By this means, it is possible to improve decoded signal quality.

(Embodiment 2)

The present invention according to Embodiment 2 divides a frequency band into several subbands and analyzes signal characteristics for each subband, thereby determining whether or not the subband is within an effective range. Then, a flag signal showing the determination is transmitted to the decoder side.

Figure 13:
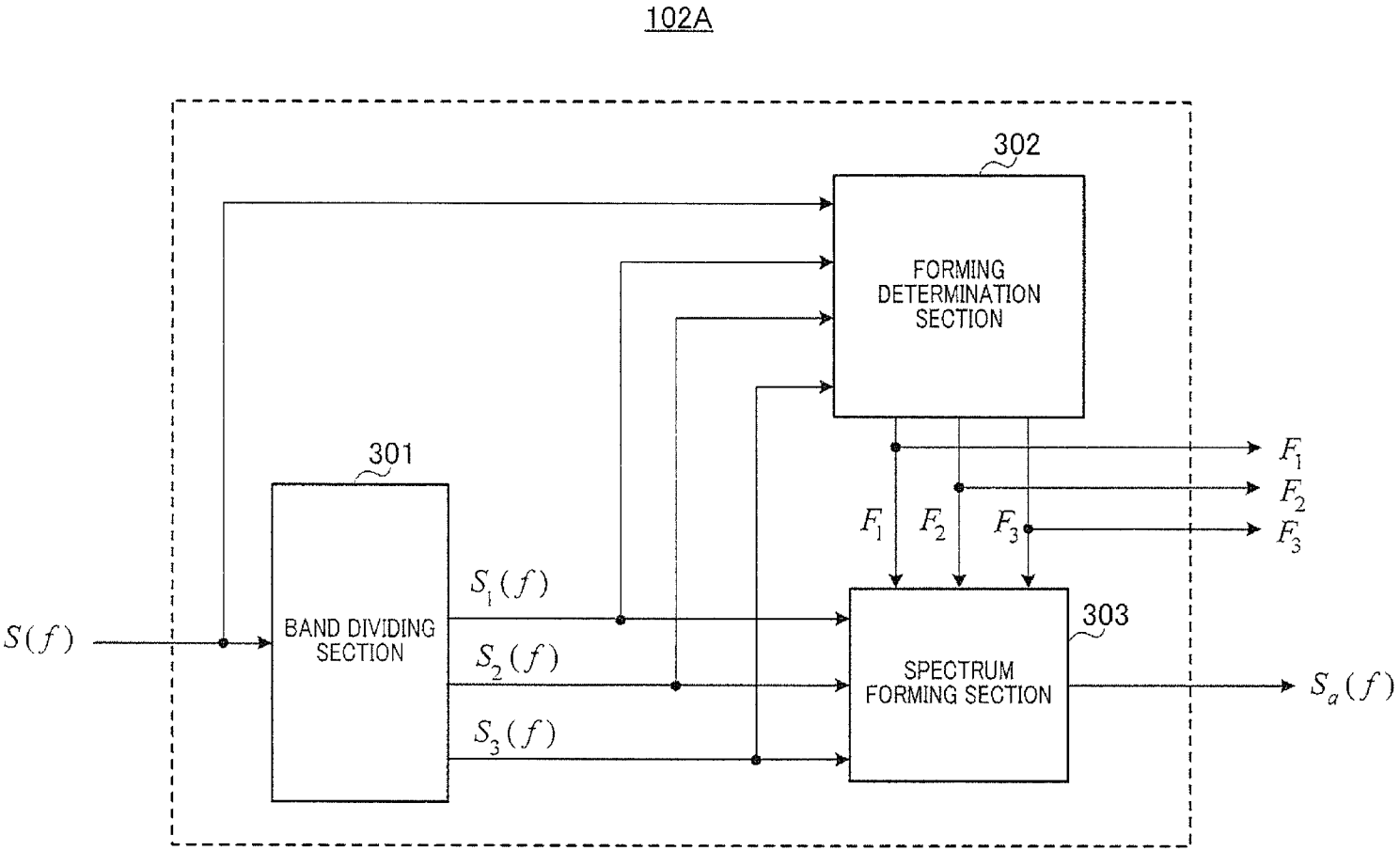
FIG. 13 is a block diagram showing a configuration of an adaptive spectrum forming coding section of an encoder according to Embodiment 2 of the present invention.

FIG. 13 is a block diagram showing a configuration of adaptive spectrum forming coding section 102A of an encoder according to Embodiment 2 of the present invention.

In FIG. 13, adaptive spectrum forming coding section 102A has band dividing section 301, forming determination section 302, and spectrum forming section 303.

Band dividing section 301 divides a frequency band of S(f) into a plurality of subbands and divides S(f) into subband signal $S_n(f)$ which is present at each subband. Here, n represents a subband number. In FIG. 13, especially, although a case is shown where the number of subbands is three, the present invention is not limited thereto.

Forming determination section 302 analyzes three subband signals $S_1(f)$, $S_2(f)$, and $S_3(f)$ together with frequency domain signal S(f). Forming determination section 302 determines whether or not each subband is within an effective range in accordance with signal characteristics of each subband signal and outputs flag signals ($F_1$,$F_2$,$F_3$) showing determination, as spectrum forming information.

Specifically, forming determination section 302 detects $S_{max}(M)$ in which an amplitude absolute value is the Mth greatest of the overall frequency domain signal S(f). Also, forming determination section 302 detects spectrum coefficient $S_{n_Max}$ (n is the number of subbands) in which an amplitude absolute value is maximum (maximum absolute amplitude) on a per subband signal basis. Then, forming determination section 302 determines whether or not each subband should he included in an effective range, based on a magnitude comparison result between $S_{max}$ (M) and spectrum coefficient $S_{n_Max}$.

Spectrum forming section 303 forms a spectrum in an effective range in accordance with the determination result output from forming determination section 302 and outputs the spectrum to pulse vector coding section 103. Flag signals ($F_1$,$F_2$,$F_3$) showing a determination are also output to multiplexing section 104 and transmitted to the decoder side through multiplexing section 104.

Figure 14:
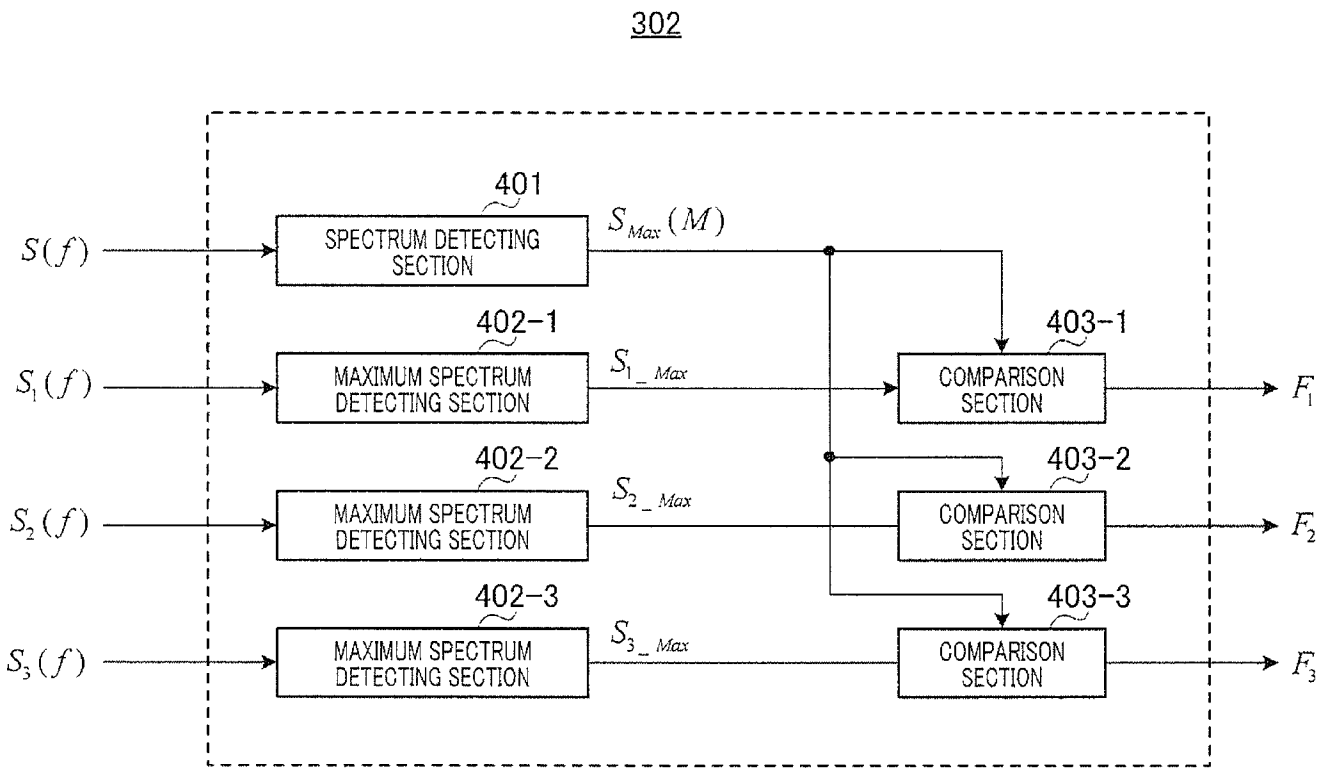
FIG. 14 is a block diagram showing a configuration of a forming determination section shown in FIG. 13.

FIG. 14 is a block diagram showing a configuration of forming determination section 302. In FIG. 14, forming determination section 302 has spectrum detecting section 401, maximum spectrum detecting section 402-1~3, and comparison section 403-1~3.

Spectrum detecting section 401 detects $S_{max}$ (M) in which an amplitude absolute value is the Mth greatest of the overall frequency domain signal S(f) (specifying of a standard value). Here, M is the number of pulses to be encoded, and is calculated from the number of available bits, and the number of spectrum coefficients in a frequency domain signal.

Of frequency domain subband signals which are included in subband 1-3, maximum spectrum detecting section 402-1~3 respectively detects spectrum coefficients $S_{1_Max}$, $S_{2_Max}$, and $S_{3_Max}$ in which an amplitude absolute value is maximum.

Comparison sections 403-1~3 compares spectrum coefficient $S_{1_Max}$ with the above-described spectrum coefficient $S_{max}$ (M), compares spectrum coefficient $S_{2_Max}$, with $S_{max}$ (M), and compares spectrum coefficient $S_{3_Max}$ with $S_{max}$ (M), and determines whether or not each subband is within an effective range.

Specifically, this determination is performed as follows. Taking the first subband as an example, the determination is performed as follows. If $S_{max}(M) \leq S_{1_max}$, this subband is within an effective range and $F_1=1$. If $S_{max}(M) > S_{1_max}$, this subband is not within an effective range and $F_1=0$. This determination is similarly carried out in the second and the third subband.

Flag signals $F_1$, $F_2$, and $F_3$ acquired in this way are transmitted to the decoder side as spectrum forming information.

Figure 15:
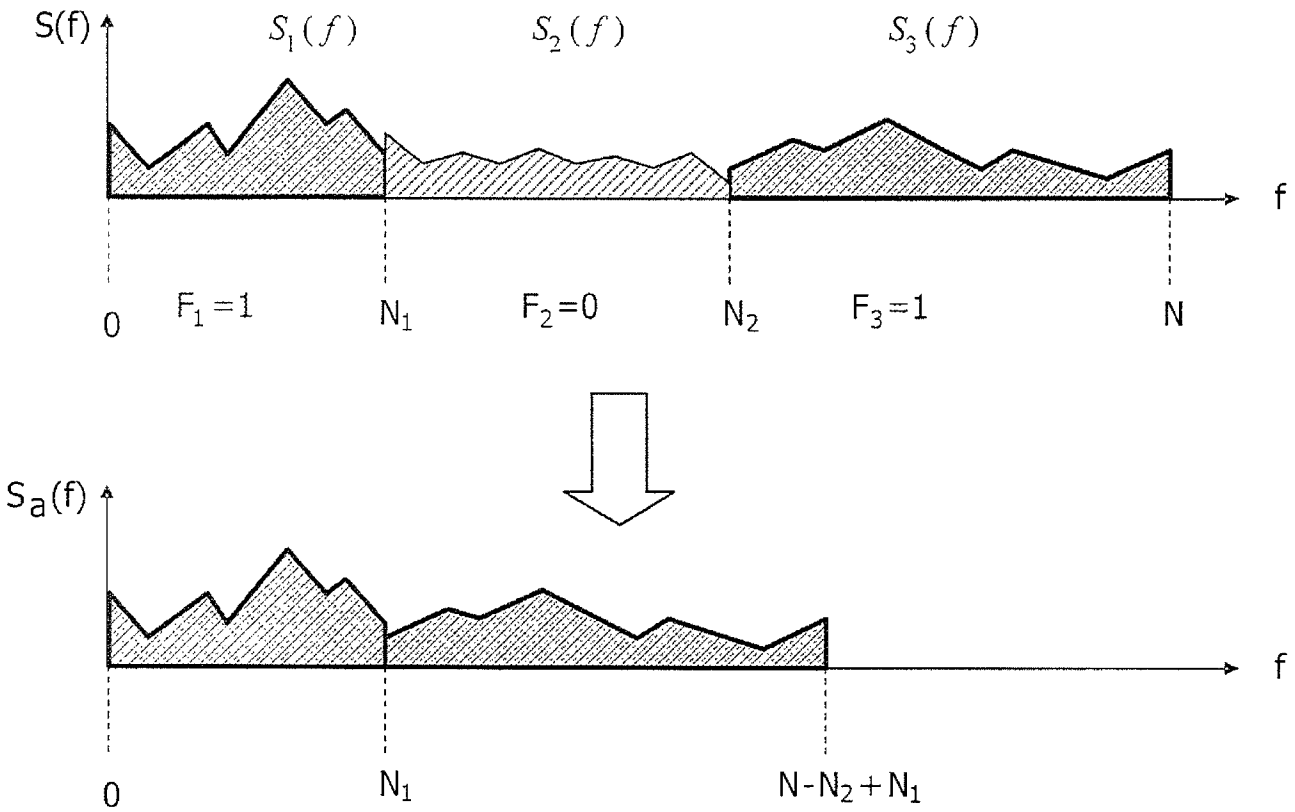
FIG. 15 illustrates processing in spectrum forming section shown in FIG. 13.

Next, the operations of adaptive spectrum forming coding section 102A having the above configurations will be described. FIG. 15 shows processing of spectrum forming section 303. Here, for an explanation, assume that flag signals of three subbands are $F_1=1$, $F_2=0$, and $F_3=1$. In this case, flag signals output from forming determination section 302 show that the first subband and the third subband are included in an effective range, and that the second subband is not included in an effective range.

Spectrum forming section 303 forms an effective range and signal $S_a(f)$ within the effective range by eliminating the second subband and adding (combining) the third subband to the first subband based on these flag signals.

Subsequent pulse vector coding section 103 performs pulse vector coding of $S_a(f)$ formed in this way.

In view of the above, according to the present embodiment, a frequency band of S(f) is divided into a plurality of subbands and S(f) is divided into subband signal $S_n(f)$ which is present at each subband. Then determination is made whether or not the subband is within an effective range by analyzing signal characteristics with respect to each subband signal, and a flag signal showing the determination is transmitted.

By this means, bits required for representing an effective range are only a flag signal of each subband, and therefore the number of bits for representing an effective range can be reduced, compared with a method of transmitting a starting position and an end position of an effective range as in Embodiment 1. Using bits reduced in this way for increasing the number of additional pulses, it is possible to further improve decoded signal quality in the decoder side.

(Embodiment 3)

The present invention according to Embodiment 3, as in Embodiment 2, divides a frequency band into several subbands and analyzes signal characteristics for each subband, thereby determining whether or not the subband is within an effective range. Then, a flag signal showing the determination is transmitted to the decoder side. It is noted that the present invention according to Embodiment 3 deals with a middle band in a frequency band as being always included in an effective range, and determines whether or not it is included in an effective range only with respect to a subband group of end parts (that is, a lower band and a higher band) in a frequency hand.

Figure 16:
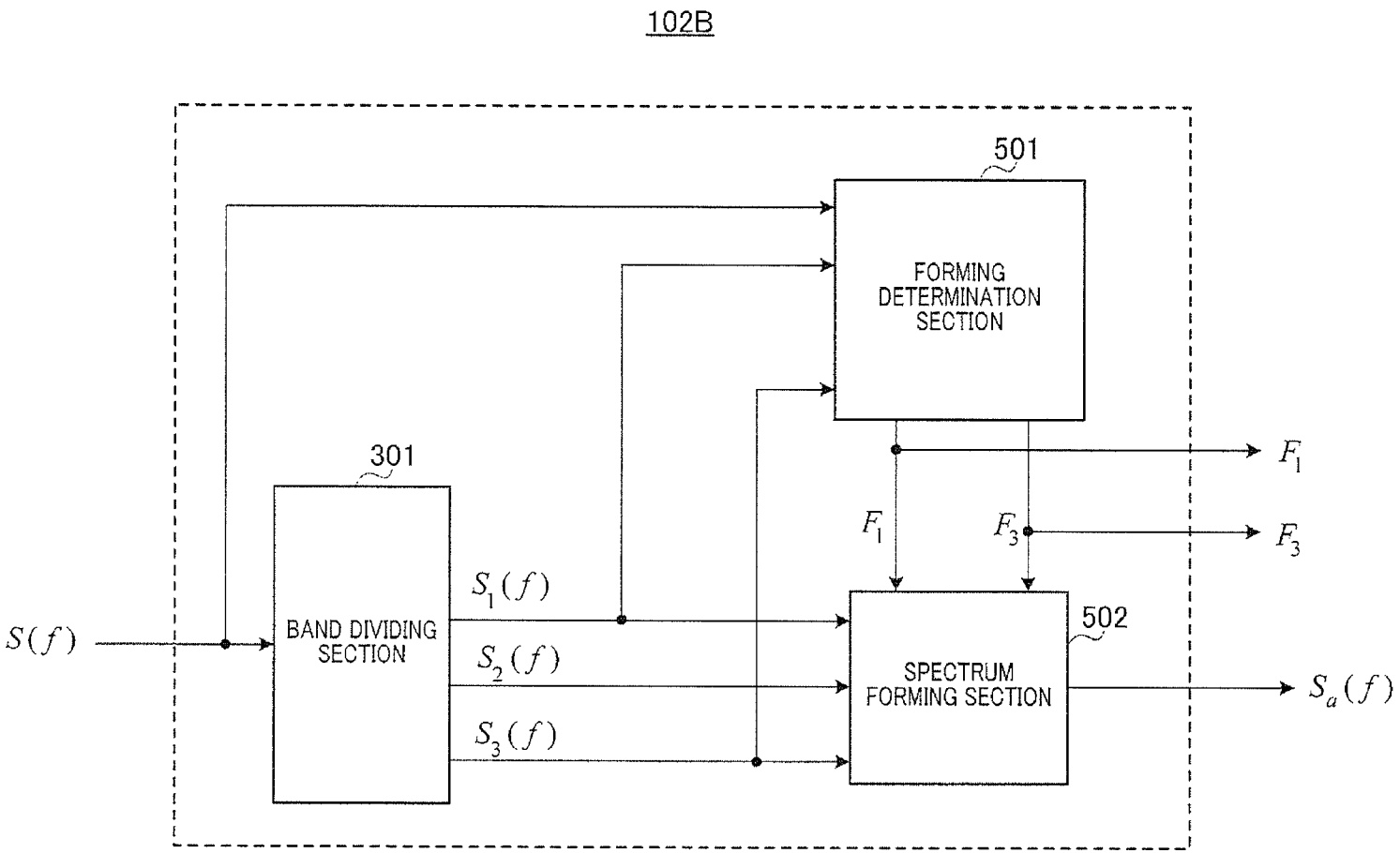
FIG. 16 is a block diagram showing a configuration of an adaptive spectrum forming coding section of an encoder according to Embodiment 3 of the present invention.

FIG. 16 is a block diagram showing a configuration of adaptive spectrum forming coding section 102B of an encoder according to Embodiment 3 of the present invention.

In FIG. 16, adaptive spectrum forming coding section 102B has band dividing section 301, forming determination section 501, and spectrum forming section 502. In FIG. 16, although a case is shown where the number of subbands is three, the present invention is not limited thereto.

Forming determination section 501 analyzes lower subband signal $S_1(f)$ and higher subband signal $S_3(f)$ of three subbands together with frequency domain signal S(f). In view of the above, since a middle band is dealt as being always included in an effective range, forming determination section 501 does not analyze middle subband signal $S_2(f)$. Then, forming determination section 501 outputs flag signals ($F_1$, $F_3$) showing determination as spectrum forming information.

Spectrum forming section 502 forms a spectrum in an effective range in accordance with a determination result output from forming determination section 501 and outputs the spectrum to pulse vector coding section 103. Flag signals ($F_1$,$F_3$) showing determination are also output to multiplexing section 104 and transmitted to the decoder side through multiplexing section 104.

Figure 17:
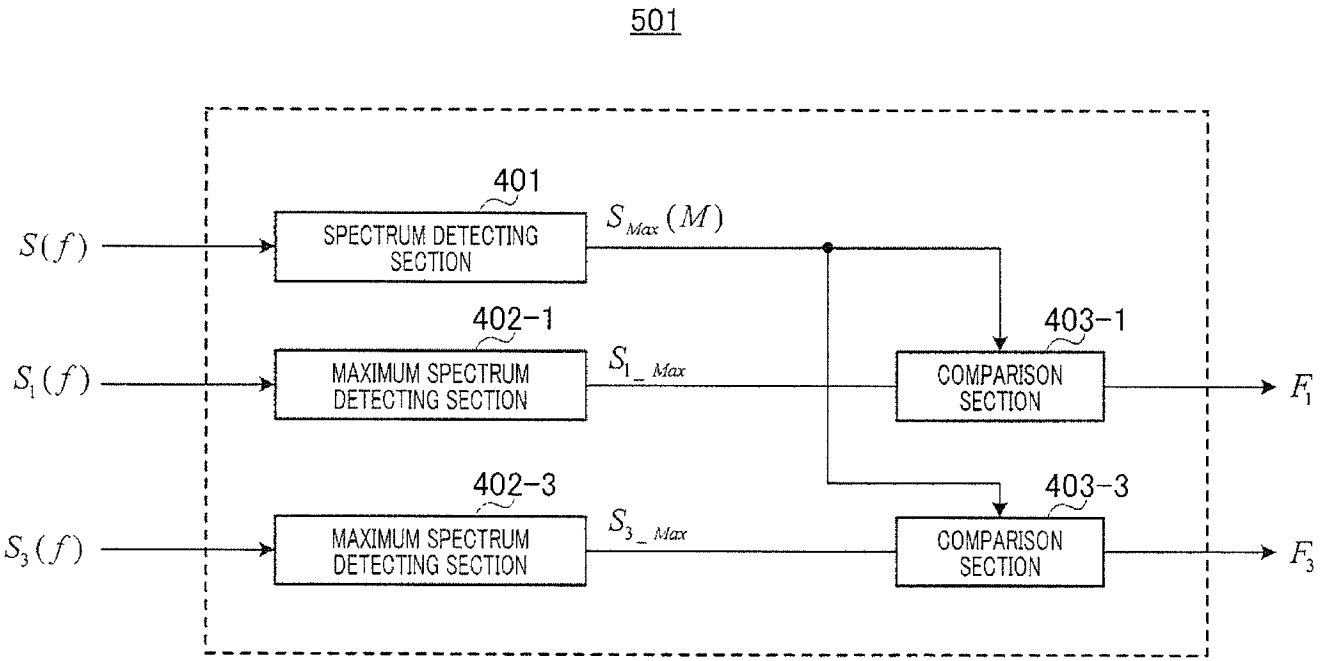
FIG. 17 is a block diagram showing a configuration of a forming determination section shown in FIG. 16.

FIG. 17 is a block diagram showing a configuration of forming determination section 501. In FIG. 17, forming determination section 501 has spectrum detecting section 401, maximum spectrum detecting section 402-1, 3, and comparison section 403-1, 3.

Figure 18:
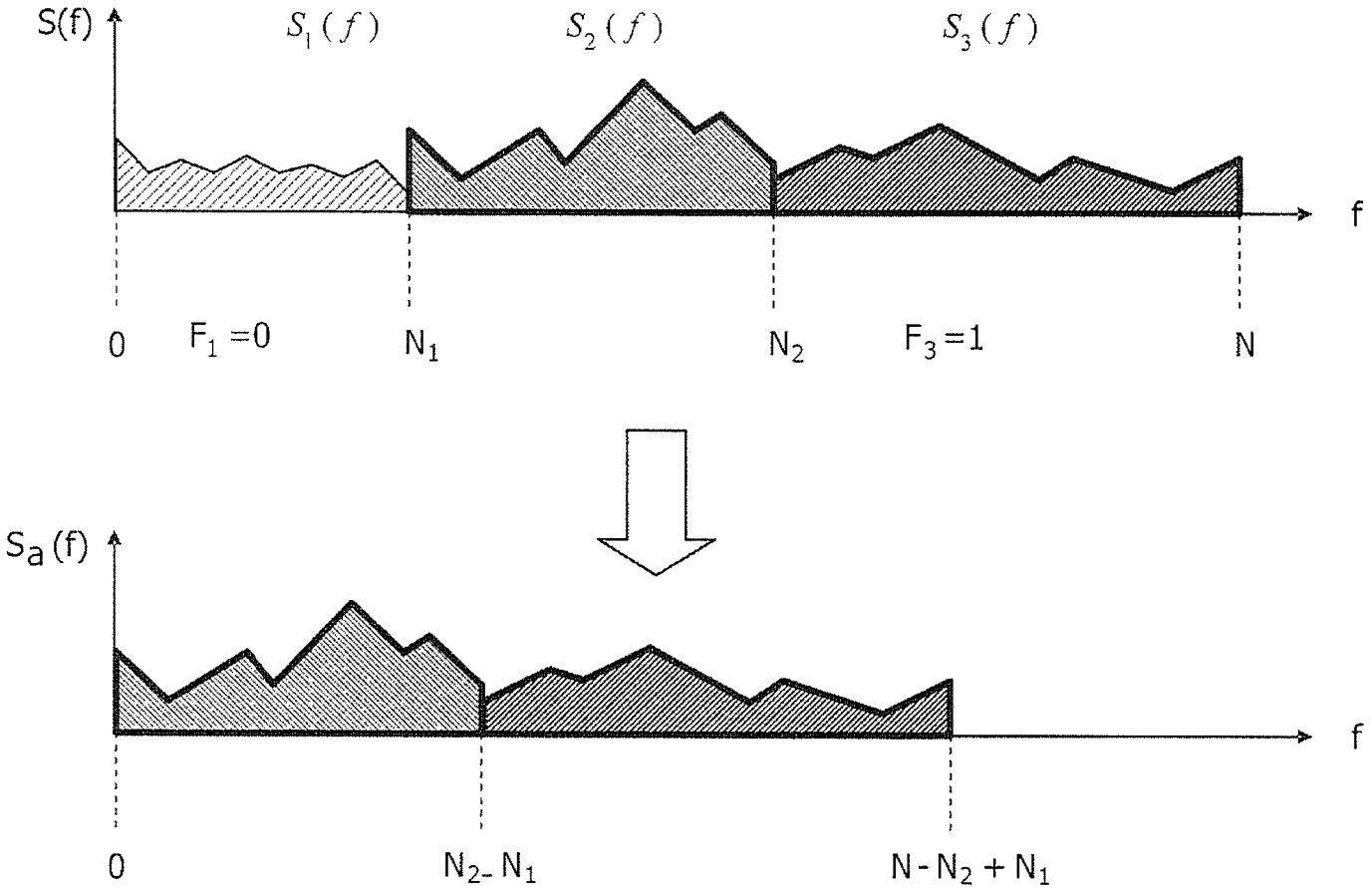
FIG. 18 illustrates processing in spectrum forming section shown in FIG. 16.

Next, the operations of adaptive spectrum forming coding section 102B having the above configurations will be described. FIG. 18 shows processing of spectrum forming section 502. Here, for an explanation, flag signals of three subbands are $F_1=0$ and $F_3=1$. In this case, flag signals output from forming determination section 501 show that the third subband is included in an effective range, and that the first subband is not included in an effective range.

Spectrum forming section 502 forms an effective range and signal $S_a(f)$ within the effective range by eliminating the first subband and adding (combining) the third subband to the second subband which is dealt as being always included in an effective range, based on these flag signals.

Subsequent pulse vector coding section 103 performs pulse vector coding of $S_a(f)$ formed in this way.

The above-described configuration of adaptive spectrum forming coding section 102B is effective for an input signal containing perceptually-important information in a middle band. For example, there is a configuration of coding a lower band in a lower layer and coding all bands in a higher layer in layered coding (scalable coding). In this case, a lower band of a signal coded in a higher layer is formed with a differential signal between an input signal and a lower layer decoded signal, and a higher band is formed with an input signal itself. At this time, since a lower band has been already coded in a lower layer, there is low possibility that important information remains in a lower band. On the other hand, in a higher hand, especially, a speech signal rarely contains important information originally. In such a signal, since a middle band contains relatively-important information and therefore, it is better to always include a subband corresponding to a middle band in an effective range, and flag information may be only two bits for $F_1$ and $F_3$ of a lower band and a higher band at that time.

Besides configurations described in Embodiments 2 and 3, according to characteristics of an input signal, there can be various configurations in an adaptive spectrum forming coding section which specifies an effective range by dividing a frequency band into several subbands and analyzing signal characteristics for each subband to determine whether or not the band is within an effective range.

(Embodiment 4)

Embodiment 4 combines an adaptive spectrum forming technology with a signal classification section or a psychoacoustic model, or signal-to-noise ratio calculation or the like. By this means, it is possible to determine an effective range more appropriately in accordance with signal characteristics, perceptual importance, or SNR, each of which is the processing output. For example, since a lower frequency part is more important for a signal such as speech, it is possible to place a greater emphasis on the lower frequency part upon applying an adaptive spectrum forming technology when an input signal is classified as speech or the like.

Figure 19:
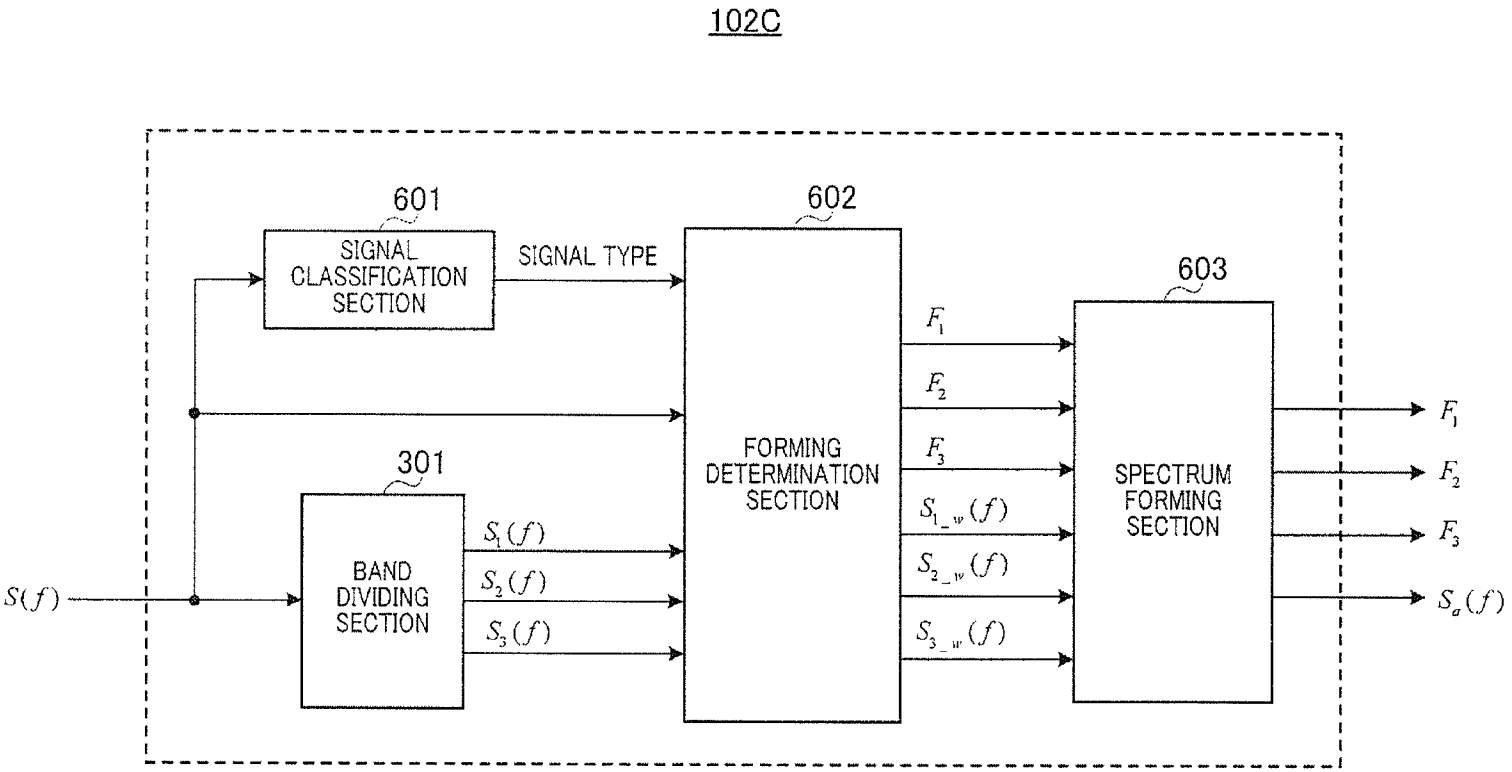
FIG. 19 is a block diagram showing a configuration of an adaptive spectrum forming coding section of an encoder according to Embodiment 4 of the present invention.

FIG. 19 is a block diagram showing a configuration of adaptive spectrum forming coding section 102C of an encoder according to Embodiment 4 of the present invention. Here, a signal classification section is employed as an example. One of ordinary skill in the art may modify to adapt any combination of other characteristic analysis methods, for example, a psychoacoustic analysis section or a signal-to-noise ratio calculation section, or a signal classification section, a psychoacoustic analysis section, and a signal-to-noise ratio calculation section. In FIG. 19, although a case is shown where the number of subbands is three, the present invention is not limited thereto.

In FIG. 19, adaptive spectrum forming coding section 102C has band dividing section 301, signal classification section 601, forming determination section 602, and spectrum forming section 603.

Signal classification section 601 analyzes frequency domain signal S(f) and classifies signal characteristics of a coding target signal. An object of signal classification section 601 is to determine signal characteristics, for example, whether a signal is a music signal and the like, or speech and the like, and whether signal change is significant or stable.

Forming determination section 602 analyzes three subband signals $S_1(f)$, $S_2(f)$, and $S_3(f)$ together with frequency domain signal S(f). Forming determination section 602 perceptually applies weight to a subband signal by taking into account signal type information according to the signal characteristics for each subband. Then, forming determination section 602 determines whether or not a subband is within an effective range based on the weighted subband signal and outputs flag signals ($F_1$,$F_2$,$F_3$) showing the determination.

Specifically, forming determination section 602 applies weight to subband signals $S_1(f)$, $S_2(f)$, and $S_3(f)$ according to signal characteristics determined in signal classification section 601, and detects spectrum coefficient $S_{n_Max}$ (n is the number of subbands) in which an amplitude absolute value is maximum, on a per weighted subband signal basis. Then, forming determination section 602 determines whether or not each subband should be included in an effective range, based on a magnitude comparison result between $S_{max}$ (M) and spectrum coefficient $S_{n_Max}$.

Spectrum forming section 603 forms a spectrum in an effective range in accordance with a determination result output from forming determination section 602 and weighted subband signals $S_{1_w}(f)$, $S_{2_w}(f)$, and $S_{3_w}(f)$ and outputs the spectrum to pulse vector coding section 103.

Figure 20:
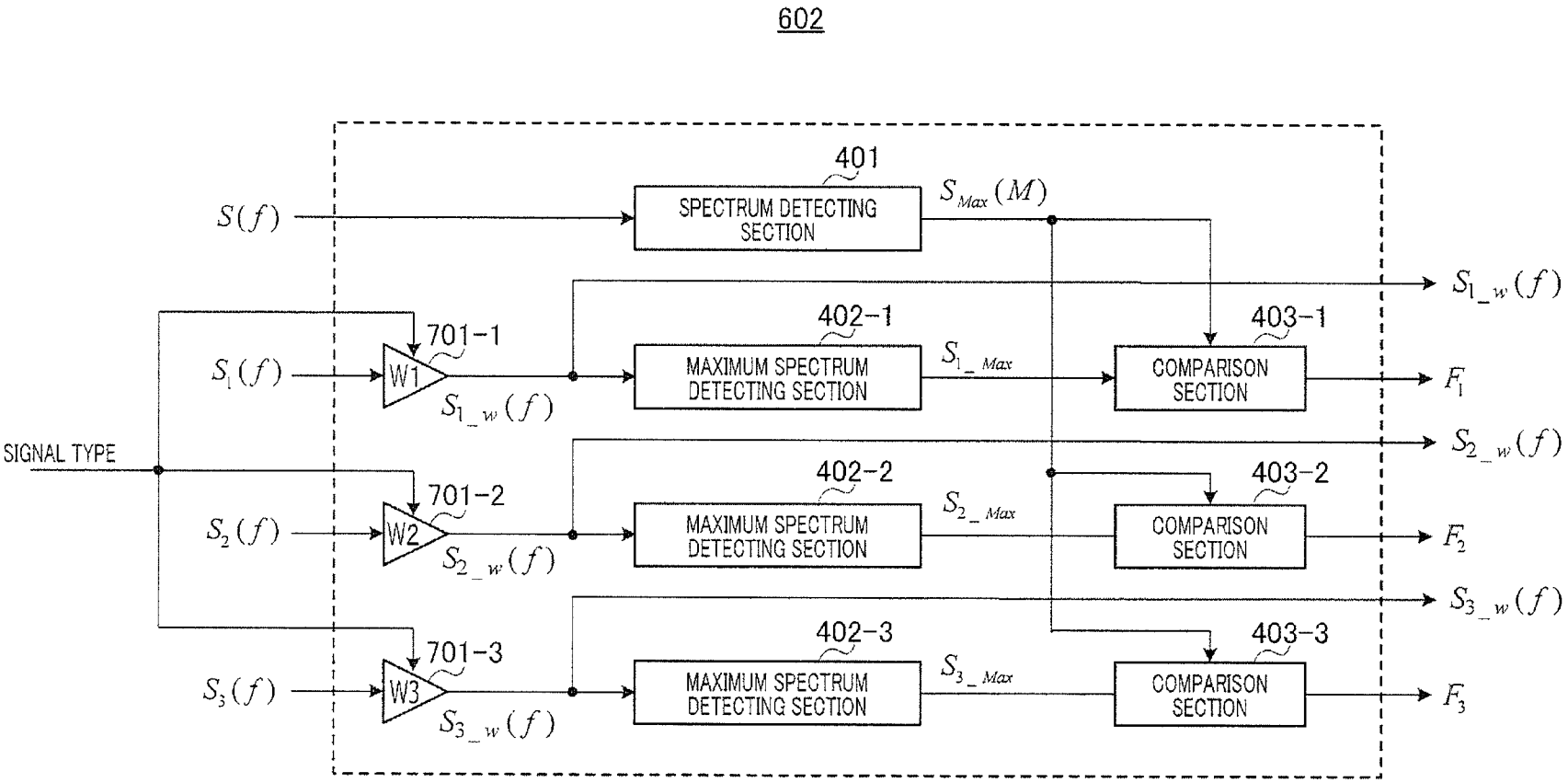
FIG. 20 is a block diagram showing a configuration of a forming determination section shown in FIG. 19.

FIG. 20 is a block diagram showing a configuration of forming determination section 602. In FIG. 20, forming determination section 602 has weighting section 701-1~3.

Weighting section 701-1~3 perceptually applies weight to each subband signal in accordance with perceptual importance, according to signal classification information. These weights are adaptively determined in accordance with signal classification information. For example, in a case where an input signal is classified as speech or the like, since a lower frequency part is more perceptually-important, weights are determined so as to be $W_1>W_2>W_3>0$.

Maximum spectrum detecting section 402-1~3 respectively detects spectrum coefficients $S_{1Max}$, $S_{2_Max}$, and $S_{3_Max}$ in which an amplitude absolute value is maximum, in each of the weighted subband signals $S_{1_w}(f)$, $S_{2_w}(f)$, and $S_{3_w}(f)$.

In view of the above, according to the present embodiment, an adaptive spectrum forming technology is combined with a signal classification section or a psychoacoustic model, or a signal-to-noise ratio calculation section, and an effective range is determined more appropriately in accordance with signal characteristics or perceptual importance, or coding performance, each of which is the output processing.

Upon pulse selection in pulse vector coding, amplitude information is only considered as a condition. Accordingly, it is possible to place a greater emphasis on spectrum coefficients which is perceptually more important by applying different weight to different frequency domain signals, thereby lowering the importance degree of spectrum coefficients having perceptually low importance. For example, since a lower frequency part is more important for a signal such as speech, a greater emphasis is placed on the lower frequency part upon applying an adaptive spectrum forming technology when an input signal is classified as a speech signal or the like. By this means, sound quality can be improved.

(Embodiment 5)

An adaptive spectrum forming technology described in Embodiments 1-4 can be applied not only to transform coding but also to TCX coding. In Embodiment 5, a case will be described where an adaptive spectrum forming technology described in Embodiments 1-4 is applied to TCX coding.

Figure 21:
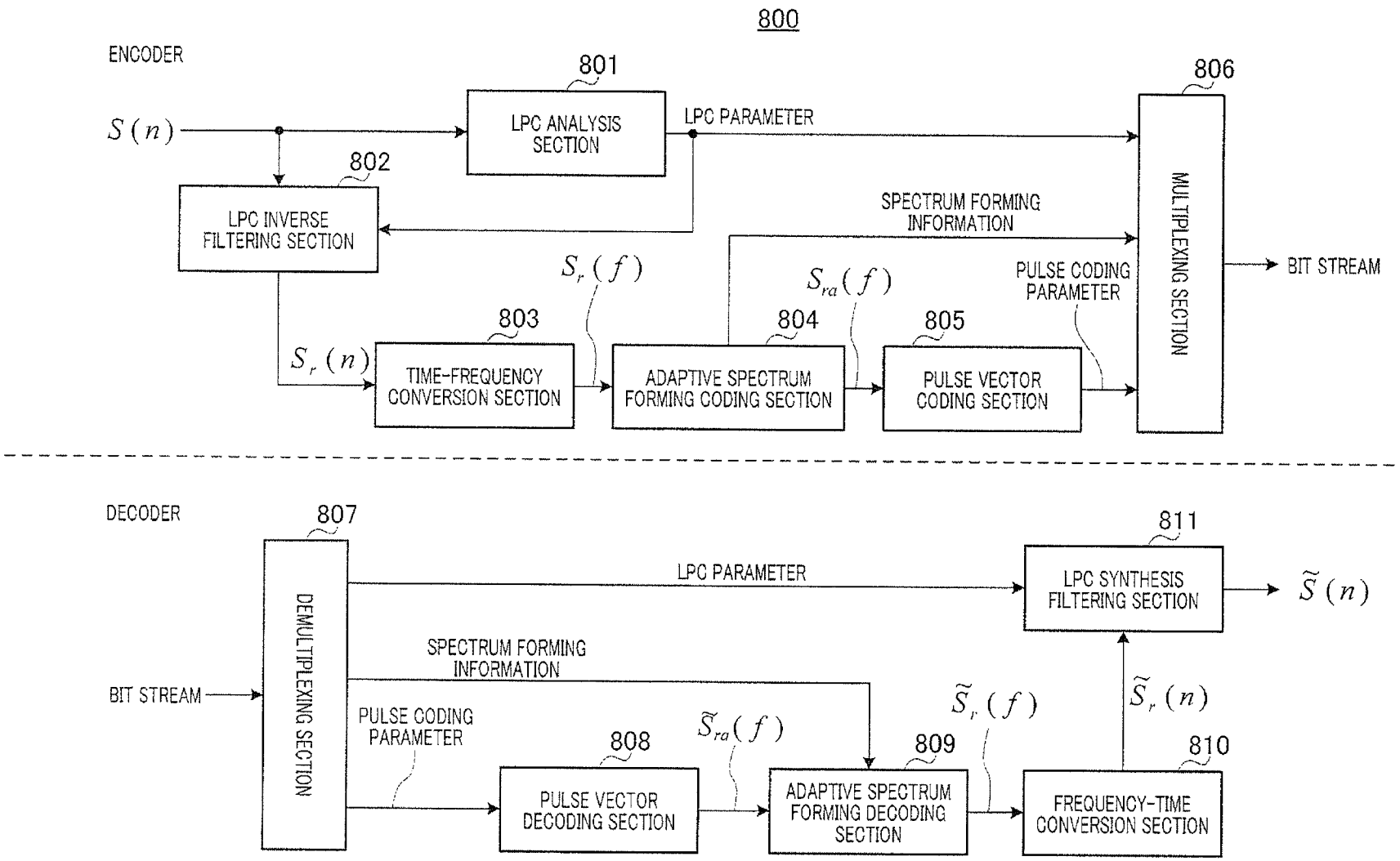
FIG. 21 is a block diagram showing a configuration of a coding system according to Embodiment 5 of the present invention.

FIG. 21 is a block diagram showing a configuration of coding system 800 according to Embodiment 5 of the present invention. In an encoder, an adaptive spectrum forming coding section is provided before a pulse vector coding section, and in a decoder, an adaptive spectrum forming decoding section is provided after a pulse vector decoding section. In FIG. 21, an encoder has LPC analysis section 801, LPC inverse filtering section 802, time-frequency conversion section 803, adaptive spectrum forming coding section 804, pulse vector coding section 805, and multiplexing section 806. On the other hand, a decoder has demultiplexing section 807, pulse vector decoding section 808, adaptive spectrum forming decoding section 809, frequency-time conversion section 810, and LPC synthesis filtering section 811.

In FIG. 21, LPC analysis section 801 performs LPC analysis for an input signal to utilize signal redundancy in the time domain.

LPC inverse filtering section 802 acquires residual (excitation) signal $S_r(n)$ by applying a LPC inverse filter to input signal S(n) using LPC coefficients from LPC analysis.

Time-frequency conversion section 803 converts residual signal $S_r(n)$ into frequency domain signal $S_r(f)$ using, for example, discrete Fourier transform (DFT), modified discrete cosine transform (MDCT) or the like.

One of adaptive spectrum forming coding sections 102, 102A, 102B, 102C, which are described in Embodiments 1-4, is applied to adaptive spectrum forming coding section 804. Spectrum forming coding section 804 acquires $S_{ra}(f)$ which falls within an effective range of $S_r(f)$. Adaptive spectrum forming coding section 804 transmits spectrum forming information to the decoder side through multiplexing section 806.

Pulse vector coding section 805 performs pulse vector coding for the spectrum coefficient of $S_{ra}(f)$ which falls within the effective range thereby acquiring a pulse coding parameter such as a pulse position, a pulse amplitude, a pulse polarity, and a global gain.

Multiplexing section 806 multiplexes a pulse coding parameter acquired in pulse vector coding section 805, spectrum forming information acquired in adaptive spectrum forming coding section 804, and a LPC parameter acquired in LPC analysis section 801 and transmits the multiplexing result to the decoder side.

Also, in a decoder shown in FIG. 21, demultiplexing section 807 receives a bit stream as input and demultiplexes the input bit stream into spectrum forming information, a pulse coding parameter, and a LPC parameter.

Pulse vector decoding section 808 acquires spectrum coefficients of $S_{ra}(f)$ by decoding a pulse coding parameter. $S_{ra}(f)$ corresponds to $S_{ra}(f)$ and is a base signal for forming $S_r(f)$ which is a decoded signal of residual frequency domain signal $S_r(f)$.

Adaptive spectrum forming decoding section 809 generates frequency domain signal $S_r(f)$ using spectrum coefficients of $S_{ra}(f)$ and spectrum forming information showing an effective range.

Frequency-time conversion section 810 generates time domain signal $S_r(n)$ by converting frequency domain signal $S_r(f)$ into the time domain using inverse discrete Fourier transform (IDFT), inverse modified discrete cosine transform (IMDCT) or the like.

LPC synthesis filtering section 811 acquires signal S(n) corresponding to signal S(n) in the encoder side by filtering time domain signal $S_r(n)$ using a LPC parameter demultiplexed in demultiplexing section 807.

In view of the above, the same kind of effect as in Embodiments 1-4 can also be obtained in a case where an adaptive spectrum forming technology is applied to TCX coding.

(Other Embodiments)

(1) Although Embodiments 2 and 3 have been described based on an assumption that the number of pulses M is fixed, different values may be employed for the number of pulses M according to input signal characteristics.

(2) An adaptive spectrum forming technology described in Embodiments 2 and 3 may be applied to at least one layer of layered coding (scalable coding). If the present invention is applied to a higher layer, there may be a case where the number of available bits in a higher layer varies according to coding processing in a lower layer. In this case, the number of pulses M is changed according to the number of available bits in a higher layer to which the present invention is applied. For example, when the number of available bits is large, the number of pulses is increased, and when the number of available bits is small, the number of pulses is decreased. In view of the above, it is possible to use bits efficiently by adaptively changing the number of pulses according to preceding processing, thereby enabling sound quality to be improved.

(3) In each of the above embodiments, cases have been described by way of example where the present invention is configured as hardware, but it is also possible for the present invention to he implemented by software.

Also, a coding system, an encoder, and a decoder according to each of the above embodiments are applicable to a communication terminal apparatus or a base station apparatus.

Each function block employed in the description of each of the above embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, a programmable field programmable gate array (FPGA) or a reconfigurable processor where connections and settings of circuit cells within an LSI can be reconfigured can be utilized.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No.2009-250441, filed on Oct. 30, 2009, including the specification, drawings and abstract, is incorporated herein by reference in its entirety.

INDUSTRIAL APPLICABILITY

An encoder, a decoder according to the present invention, and a method thereof are useful for improving decoded signal quality by improving bit efficiency in coding.

REFERENCE SIGNS LIST

100, 800 Coding system
101, 803 Time-frequency conversion section
102, 804 Adaptive spectrum forming coding section
103, 805 Pulse vector coding section
104, 806 Multiplexing section
105, 807 Demultiplexing section

106, 808 Pulse vector decoding section
107, 809 Adaptive spectrum forming decoding section
108, 810 Frequency-time conversion section
201 Spectrum specifying section
202 Minimum position specifying section
203 Maximum position specifying section
301 Band dividing section
302, 501, 602 Forming determination section
303, 502, 603 Spectrum forming section
401 Spectrum detecting section
402 Maximum spectrum detecting section
403 Comparison section
601 Signal classification section
701 Weighting section
801 LPC analysis section
802 LPC inverse filtering section
811 LPC synthesis filtering section

The invention claimed is:

1. An encoder comprising:

a time-frequency conversion section that converts a coding target signal into a frequency domain signal;

an effective range specifying section that specifies an effective range in a frequency band of the frequency domain signal; and a pulse vector coding section that performs pulse vector coding on only a signal component within the effective range.

2. The encoder according to claim 1, wherein the effective range specifying section comprises:

a spectrum specifying section that specifies a plurality of spectrum coefficients in descending order of an amplitude absolute value in the frequency domain signal;

a minimum position specifying section that detects a minimum frequency of frequency positions of the plurality of spectrum coefficients, as a starting point of the effective range; and a maximum position specifying section that detects a maximum frequency of frequency positions of the plurality of spectrum coefficients, as an end point of the effective range.

3. The encoder according to claim 2, wherein the minimum position specifying section and the maximum position specifying section detect the minimum frequency and the maximum frequency by storing positions of the plurality of spectrum coefficients in a sequence and sorting the sequence.

4. The encoder according to claim 2, wherein the effective range specifying section outputs the minimum frequency and the maximum frequency as effective range information.

5. The encoder according to claim 1, wherein the effective range specifying section determines whether or not the frequency band is within an effective range, for each of a plurality of divided subbands.

6. The encoder according to claim 1, wherein the effective range specifying section comprises:

a standard value specifying section that specifies a specific order spectrum coefficient in descending order of an amplitude absolute value in the frequency domain signal, as a standard value;

a dividing section that divides the frequency domain signal for each of a plurality of subbands into which the frequency band is divided, and acquires a subband signal;

a detecting section that detects spectrum coefficients in which an amplitude absolute value is maximum, for each subband acquired in the dividing section; and a determination section that determines whether or not a subband in which the detected spectrum coefficient is present is within an effective range, by comparing the detected spectrum coefficient with the standard value.

7. The encoder according to claim 1, wherein the effective range specifying comprises:

a standard value specifying section that specifies a specific order spectrum coefficient in descending order of an amplitude absolute value in the frequency domain signal, as a standard value;

a signal classification section that classifies signal characteristics of the coding target signal;

a dividing section that divides the frequency domain signal for each of a plurality of subbands into which the frequency band is divided, and acquires a subband signal;

a weighting section that multiplies each of a plurality of subband signals acquired in the dividing section by weight according to the classified signal characteristics;

a detecting section that detects spectrum coefficients in which an amplitude absolute value is maximum, for each of the weighted subband signal; and a determination section that determines whether or not a subband in which the detected spectrum coefficient is present is within an effective range, by comparing the detected spectrum coefficient with the standard value.

8. The encoder, according to claim 5, wherein the effective range specifying section outputs a flag signal showing a subband determined to be within an effective range, as effective range information.

9. A decoder comprising:

a pulse vector decoding section that performs pulse vector decoding on a pulse coding parameter coded in the encoder according to claim 1;

a spectrum forming section that arranges a decoded signal acquired in the pulse vector decoding section in a band corresponding to the effective range; and a frequency-time conversion section that converts a decoded signal arranged in the band corresponding to the effective range into a time domain signal.

10. A coding method comprising :

a step of converting a coding target signal into a frequency domain signal;

a step of specifying an effective range in a frequency band of the frequency domain signal; and a step of performing pulse vector coding on only a signal component within the effective range.

11. A decoding method comprising:

a decoding step of performing pulse vector decoding on a pulse coding parameter coded in the coding method according to claim 10;

a spectrum forming step of arranging a decoded signal acquired in the decoding step, in a band corresponding to the effective range; and a converting step of converting a decoded signal arranged in the band corresponding to the effective range into a time domain signal.

* * * * *